US005820730A

United States Patent [19]

Phan et al.

[11] Patent Number: 5,820,730

[45] Date of Patent: Oct. 13, 1998

[54] PAPER STRUCTURES HAVING AT LEAST THREE REGIONS INCLUDING DECORATIVE INDICIA COMPRISING LOW BASIS WEIGHT REGIONS

[75] Inventors: Dean Van Phan, West Chester; Paul Dennis Trokhan, Hamilton; Jane Ann Hooper, West Chester, all of Ohio

[73] Assignee: The Procter & Gamble Company, Cincinnati, Ohio

[21] Appl. No.: 803,696

[22] Filed: Feb. 21, 1997

Related U.S. Application Data

[63] Continuation-in-part of Ser. No. 710,822, Sep. 23, 1996, which is a continuation of Ser. No. 613,797, Mar. 1, 1996, Pat. No. 5,614,061, which is a continuation of Ser. No. 382,551, Feb. 2, 1995, abandoned, which is a division of Ser. No. 71,834, Jul. 28, 1993, Pat. No. 5,443,691, which is a continuation of Ser. No. 724,551, Jun. 28, 1991, Pat. No. 5,277,761.

[51] Int. Cl.[6] ..... D21H 27/02

[52] U.S. Cl. ..... 162/112; 162/109; 162/113; 162/117; 428/153; 428/154

[58] Field of Search ..... 162/109, 11 B, 162/112, 115, 116, 206, 123, 117; 428/153, 154; 536/56

[56] References Cited

U.S. PATENT DOCUMENTS

| | | | |
|---|---|---|---|
| 1,616,222 | 2/1927 | Harrigan . | |
| 1,687,140 | 10/1928 | Pleyer . | |
| 1,699,760 | 1/1929 | Sherman . | |
| 2,771,363 | 11/1956 | Fish | 162/117 |
| 2,862,251 | 12/1958 | Kalwaites | 19/161 |
| 2,902,395 | 9/1959 | Hirschy et al. | 161/57 |
| 3,025,585 | 3/1962 | Griswold | 28/1 |
| 3,034,180 | 5/1962 | Greiner et al. | 19/155 |
| 3,072,511 | 1/1963 | Harwood | 154/46 |
| 3,081,500 | 3/1963 | Griswold et al. | 19/161 |
| 3,081,512 | 3/1963 | Griswold | 28/72 |
| 3,081,514 | 3/1963 | Griswold | 28/78 |
| 3,081,515 | 3/1963 | Griswold et al. | 28/78 |
| 3,159,530 | 12/1964 | Heller et al. | 162/348 |
| 3,322,617 | 5/1967 | Osborne | 162/296 |
| 3,491,802 | 1/1970 | Mortensen et al. | 139/420 |
| 3,681,182 | 8/1972 | Kalwaites | 161/109 |
| 3,681,183 | 8/1972 | Kalwaites | 161/109 |
| 3,881,987 | 5/1975 | Benz | 162/116 |
| 4,191,609 | 3/1980 | Trokhan | 162/113 |
| 4,529,480 | 7/1985 | Trokhan | 162/109 |
| 4,637,859 | 1/1987 | Trokhan | 162/109 |
| 4,840,829 | 6/1989 | Suzuki et al. | 428/131 |
| 4,921,034 | 5/1990 | Burgess et al. | 162/109 |
| 5,098,519 | 3/1992 | Ramasubramanian et al. | 162/109 |
| 5,126,015 | 6/1992 | Pounder | 162/206 |
| 5,245,025 | 9/1993 | Trokhan et al. | 536/56 |
| 5,431,786 | 7/1995 | Rasch et al. | 162/348 |
| 5,443,691 | 8/1995 | Phan et al. | 162/115 |
| 5,503,715 | 4/1996 | Trokhan et al. | 162/296 |
| 5,527,428 | 6/1996 | Trokhan et al. | 162/116 |
| 5,556,509 | 9/1996 | Trokhan et al. | 162/111 |

FOREIGN PATENT DOCUMENTS

| | | |
|---|---|---|
| 0312 512 | 4/1989 | European Pat. Off. . |
| 1117731 | 12/1964 | United Kingdom . |
| 1008703 | 11/1965 | United Kingdom . |
| WO 91/02642 | 3/1991 | WIPO . |
| WO 94/03677 | 2/1994 | WIPO . |
| WO 96/35018 | 11/1996 | WIPO . |

*Primary Examiner*—Stanley S. Silverman
*Assistant Examiner*—Jose A. Fortuna
*Attorney, Agent, or Firm*—Gerry S. Gressel; Roddy M. Bullock; Larry L. Huston

[57] ABSTRACT

A paper web is disclosed. The paper web includes at least three regions disposed in a nonrandom, repeating pattern. The three regions are distinguishable from each other by at least one property selected from the group consisting of basis weight, density, and fiber composition. The paper web has a relatively high basis weight background portion and decorative indicia. The decorative indicia comprise one or more relatively low basis weight regions.

28 Claims, 16 Drawing Sheets

PAPER STRUCTURES HAVING AT LEAST THREE REGIONS INCLUDING DECORATIVE INDICIA COMPRISING LOW BASIS WEIGHT REGIONS

CROSS-REFERENCE TO RELATED APPLICATIONS

This is a continuation-in-part of the following U.S. patent applications: Ser. No. 08/710,822, filed Sep. 23, 1996, which is a continuation of Ser. No. 08/613,797 filed Mar. 1, 1996, now U.S. Pat. No. 5,614,061, issued Mar. 25, 1997, which is a continuation of Ser. No. 08/382,551 filed Feb. 2, 1995, now abandoned which is a divisional of Ser. No. 07/071,834 filed Jul. 28, 1993; now U.S. Pat. No. 5,443,691, issued Aug. 22, 1995, which is a continuation of Ser. No. 07/724,551 filed Jun. 28, 1991; now U.S. Pat. No. 5,277,761, issued Jan. 11, 1994 in the name of Phan.

This patent application incorporates by reference U.S. Pat. No. 5,534,326 issued Jul. 9, 1996 to Trokhan et al.; U.S. Pat. No. 5,245,025 issued Sep. 14, 1993 to Trokhan et al.; U.S. Pat. No. 5,277,761 issued Jan. 11, 1994 to Phan et al.; and U.S. patent application Ser. No. 08/748,871 "Paper Web Having a Relatively Thinner Continuous Network Region and Discrete Relatively Thicker Regions in the Plane of the Continuous Network Region," filed Nov. 14, 1996 in the name of Phan.

FIELD OF THE INVENTION

The present invention relates to cellulosic fibrous structures having at least three regions distinguished by intensive properties, and more particularly to paper having relatively low basis weight decorative indicia and a method for making such paper.

BACKGROUND OF THE INVENTION

Cellulosic fibrous structures, such as paper, are well known in the art. Frequently, it is desirable to have regions of different basis weights within the same cellulosic fibrous product. The two regions serve different purposes. The regions of higher basis weight impart tensile strength to the fibrous structure. The regions of lower basis weight may be utilized for economizing raw materials, particularly the fibers used in the papermaking process and to impart absorbency to the fibrous structure. In a degenerate case, the low basis weight regions may represent apertures or holes in the fibrous structure. However, it is not necessary that the low basis weight regions be apertured.

The properties of absorbency and strength, and further the property of softness, become important when the fibrous structure is used for its intended purpose. Particularly, the fibrous structure described herein may be used for facial tissues, toilet tissue, paper towels, bibs, and napkins, each of which is in frequent use today. If these products are to perform their intended tasks and find wide acceptance, the fibrous structure must exhibit and maximize the physical properties discussed above. Wet and Dry Tensile strengths are measures of the ability of a fibrous structure to retain its physical integrity during use. Absorbency is the property of the fibrous structure which allows it to retain contacted fluids. Both the absolute quantity of fluid and the rate at which the fibrous structure will absorb such fluid must be considered when evaluating one of the aforementioned consumer products. Further, such paper products have been used in disposable absorbent articles such as sanitary napkins and diapers.

Attempts have been made in the art to provide paper having two different basis weights, or to otherwise rearrange fibers. Examples include U.S. Pat. No. 795,719 issued Jul. 25, 1905 to Motz; U.S. Pat. No. 3,025,585 issued Mar. 20, 1962 to Griswold; U.S. Pat. No. 3,034,180 issued May 15, 1962 to Greiner et al; U.S. Pat. No. 3,159,530 issued Dec. 1, 1964 to Heller et al; U.S. Pat. No. 3,549,742 issued Dec. 22, 1970 to Benz; and U.S. Pat. No. 3,322,617 issued May 30, 1967 to Osborne.

Separately, there is a desire to provide tissue products having both bulk and flexibility. Improved bulk and flexibility may be provided through bilaterally staggered compressed and uncompressed zones, as shown in U.S. Pat. No. 4,191,609 issued Mar. 4, 1980 to Trokhan, which patent is incorporated herein by reference.

Several attempts to provide an improved foraminous member for making such cellulosic fibrous structures are known, one of the most significant being illustrated in U.S. Pat. No. 4,514,345 issued Apr. 30, 1985 to Johnson et al., which patent is incorporated herein by reference. Johnson et al. teaches hexagonal elements attached to the framework in a batch liquid coating process.

Another approach to making tissue products more consumer preferred is to dry the paper structure to impart greater bulk, tensile strength, and burst strength to the tissue products. Examples of paper structures made in this manner are illustrated in U.S. Pat. No. 4,637,859 issued Jan. 20, 1987 to Trokhan, which patent is incorporated herein by reference. U.S. Pat. No. 4,637,859 shows discrete dome shaped protuberances dispersed throughout a continuous network, and is incorporated herein by reference. The continuous network can provide strength, while the relatively thicker domes can provide softness and absorbency.

One disadvantage of the papermaking method disclosed in U.S. Pat. No. 4,637,859 is that drying such a web can be relatively energy intensive and expensive, and typically involves the use of through air drying equipment. In addition, the papermaking method disclosed in U.S. Pat. No. 4,637,859 can be limited with respect to the speed at which the web can be finally dried on the Yankee dryer drum. This limitation is thought to be due, at least in part, to the pattern imparted to the web prior to transfer of the web to the Yankee drum. In particular, the discrete domes described in U.S. Pat. No. 4,637,859 may not be dried as efficiently on the Yankee surface as is the continuous network described in U.S. Pat. No. 4,637,859. Accordingly, for a given consistency level and basis weight, the speed at which the Yankee drum can be operated is limited.

Conventional tissue paper made by pressing a web with one or more press felts in a press nip can be made at relatively high speeds. The conventionally pressed paper, once dried, can then be embossed to pattern the web, and to increase the macro-caliper of the web. For example, embossed patterns formed in tissue paper products after the tissue paper products have been dried are common.

However, embossing processes typically impart a particular aesthetic appearance to the paper structure at the expense of other properties of the structure. In particular, embossing a dried paper web disrupts bonds between fibers in the cellulosic structure. This disruption occurs because the bonds are formed and set upon drying of the embryonic fibrous slurry. After drying the paper structure, moving fibers normal to the plane of the paper structure by embossing breaks fiber to fiber bonds. Breaking bonds results in reduced tensile strength of the dried paper web. In addition, embossing is typically done after creping of the dried paper web from the drying drum. Embossing after creping can disrupt the creping pattern imparted to the web. For instance, embossing can eliminate the creping pattern in some portions of the web by compacting or stretching the creping pattern. Such a result is undesirable because the creping pattern improves the softness and flexibility of the dried web.

One problem with paper made according to prior teachings is that an excessive amount of low basis weight regions can reduce the strength of the paper.

Accordingly, it is an object of this invention to overcome such problems, and and particularly to overcome such problems as they relate to a single lamina of paper. Specifically, it is an object of this invention to provide a paper web which has decorative indicia formed by relatively low basis weight regions, without compromising the strength, absorbency, and softness characteristics of the paper web.

Another object of the present invention is to provide a paper and method for making a multi-region paper web wherein the web has a predetermined pattern of relatively high and relatively low density regions, yet can be dried with relatively lower energy and expense.

Another object of the present invention is to provide a method for making a multi-region paper having relatively low basis weight decorative indicia which can be formed on an existing paper machine (conventional or through air drying capability) without the need for substantial modification of the papermaking machine.

Another object is to provide a paper web and method of making the paper web where the web has decorative indicia comprising low basis weight regions for providing aesthetic benefits, in combination with enhanced bulk caliper, bulk density, and absorbent capacity, thereby providing both the properties of bulk and softness desired by consumers of paper products.

BRIEF SUMMARY OF THE INVENTION

The present invention provides a paper web having oppositely facing surfaces and at least three regions. The three regions are disposed in a nonrandom, repeating pattern and are distinguishable from each other by at least one property selected from the group consisting of basis weight, density, and fiber composition. The paper web comprises decorative indicia, the decorative indicia comprising one or more regions having a basis weight which is lower than the basis weight of at least a part of the surrounding background portion of the web.

The term "decorative indicia" as used herein refers to a recognizable shape or shapes imparted to the web, preferably during initial formation of the web. Such shapes include, but are not limited to, floral shapes, animal shapes, geometric shapes, and the like. The decorative indicia preferably comprise less than about 30 percent of the surface area of the web, thereby enhancing the distinctiveness of the decorative indicia from the background portion of the web.

The background portion of the web is selectively densified to provide a relatively high density continuous network, and relatively low density regions dispersed throughout the network. The relatively high density continuous network provides strength, and the relatively low density regions provide bulk and absorbency.

In addition to the relatively low basis weight regions, the decorative indicia can include relatively high basis weight regions. The relatively low basis weight regions of the decorative indicia can enclose one or more cells having a basis weight substantially equal to the basis weight of the background, or alternatively, a basis weight different from that of the background. These relatively high basis weight cells can be encircled by the relatively low basis weight regions. These relatively high basis weight cells can be selectively densified to provide relatively high density regions and relatively low density regions within the decorative indicia.

In one embodiment, the paper web comprises between about 5 and about 5000 decorative indicia per square meter of the web. The relatively high basis weight background portion of the web comprises a relatively high density continuous network region and at least about 10,000 relatively low density regions per square meter of the web, the relatively low density regions being dispersed throughout the continuous network region. The background portion has a smoothness value of less than about 900 on at least one of the oppositely facing surfaces of the web to provide a surface which is smooth and soft to the touch.

The decorative indicia can comprise relatively low basis weight regions having a basis weight which is between about 25 percent and about 75 percent of the basis weight of the background portion surrounding the decorative indicia. The decorative indicia can comprise relatively low basis weight regions having a basis weight which is less than about 75 percent of the basis weight of the surrounding background portion. In one embodiment, the decorative indicia can comprise relatively low basis weight regions having a basis weight which is less than about 60 percent of the basis weight of the surrounding background portion.

The paper web of the present invention has the advantage that the decorative indicia provide consumer preferred aesthetics, yet the paper web maintains strength and absorbency of multi-density paper. Moreover, the paper webs of the present invention have decorative indicia and multi-density regions, yet can have a relatively smooth surface. The smooth surface provides consumer preferred softness, and can help to visually distinguish the decorative indicia. Additionally, the smooth surface surrounding the low basis weight decorative indicia accentuates the distinctiveness of the relatively low basis weight decorative indicia, thereby enhancing the aesthetic appearance of the web.

The present invention also provides a method for making a paper web having three regions disposed in a nonrandom, repeating pattern and being distinguishable from each other from at least one property selected from the group consisting of basis weight, density, and fiber composition. The method comprises the steps of: providing a plurality of cellulosic fibers suspended in a liquid carrier; providing a fiber retentive forming element having liquid pervious zones; depositing the cellulosic fibers and the liquid carrier onto the forming element; draining the liquid carrier through the forming element in two simultaneous stages to form a web having at least one relatively high basis weight region and decorative indicia comprising one or more relatively low basis weight regions; providing a web support apparatus having a web patterning surface; transferring the web from the forming element to the web patterning surface of the web support apparatus; and selectively densifying at least a portion of the relatively high basis weight region to provide a nonrandom, repeating pattern of relatively high and low density regions in the relatively high basis weight region.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which like elements are designated by the same reference numeral and:

DETAILED DESCRIPTION OF THE INVENTION

Figure 1A:
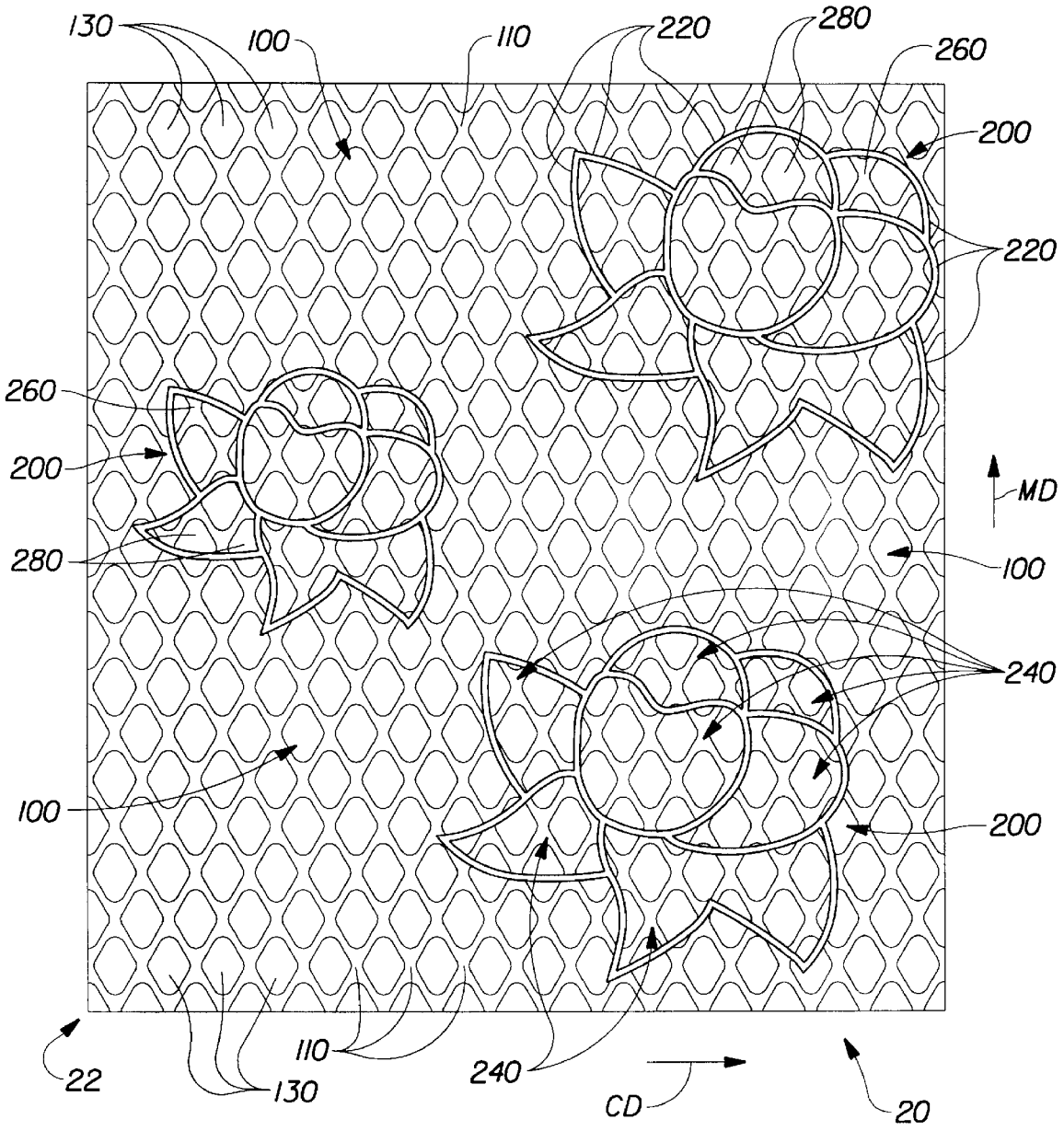
FIG. 1A is a plan view illustration of a portion of a paper web made according to the present invention, the Figure showing three decorative indicia.
Figure 3:
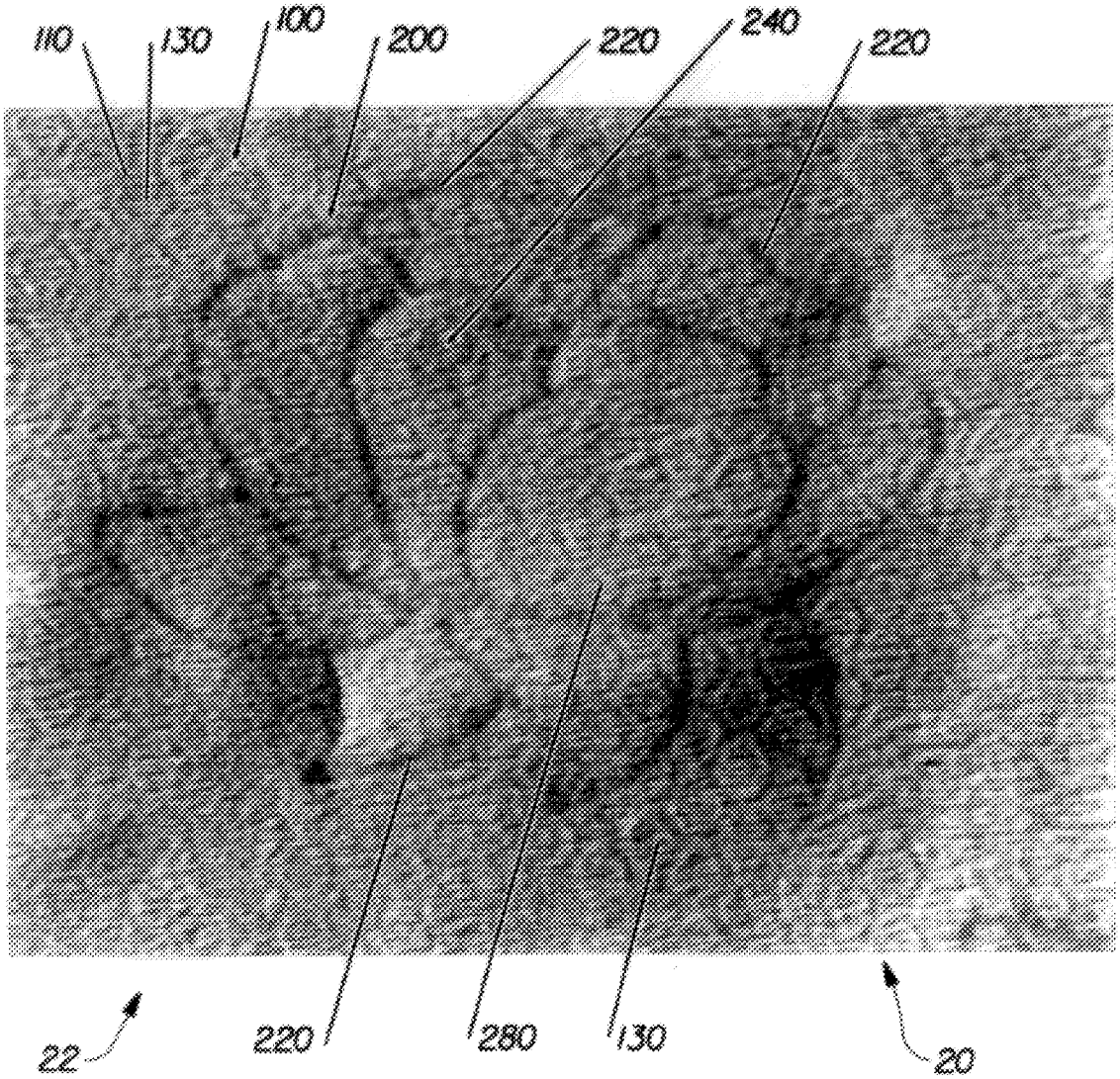
FIG. 3 is a photograph of a portion of a paper web made according to the present invention, the photo showing a single decorative indicia.

FIGS. 1A,B and 2 illustrate a paper web 20 made according to one embodiment of the present invention, and FIG. 3 is a photograph of a paper structure of the type illustrated in FIGS. 1A,B and 2. The paper web is wetlaid, and is substantially free of dry embossments.

Referring to FIGS. 1A,B and 2, the paper web 20 has first and second oppositely facing surfaces 22 and 24, respectively. The paper web 20 comprises at least three regions disposed in a nonrandom, repeating pattern. The three regions are distinguishable from each other by at least one property selected from the group consisting of basis weight, density, and fiber composition.

Figure 1B:
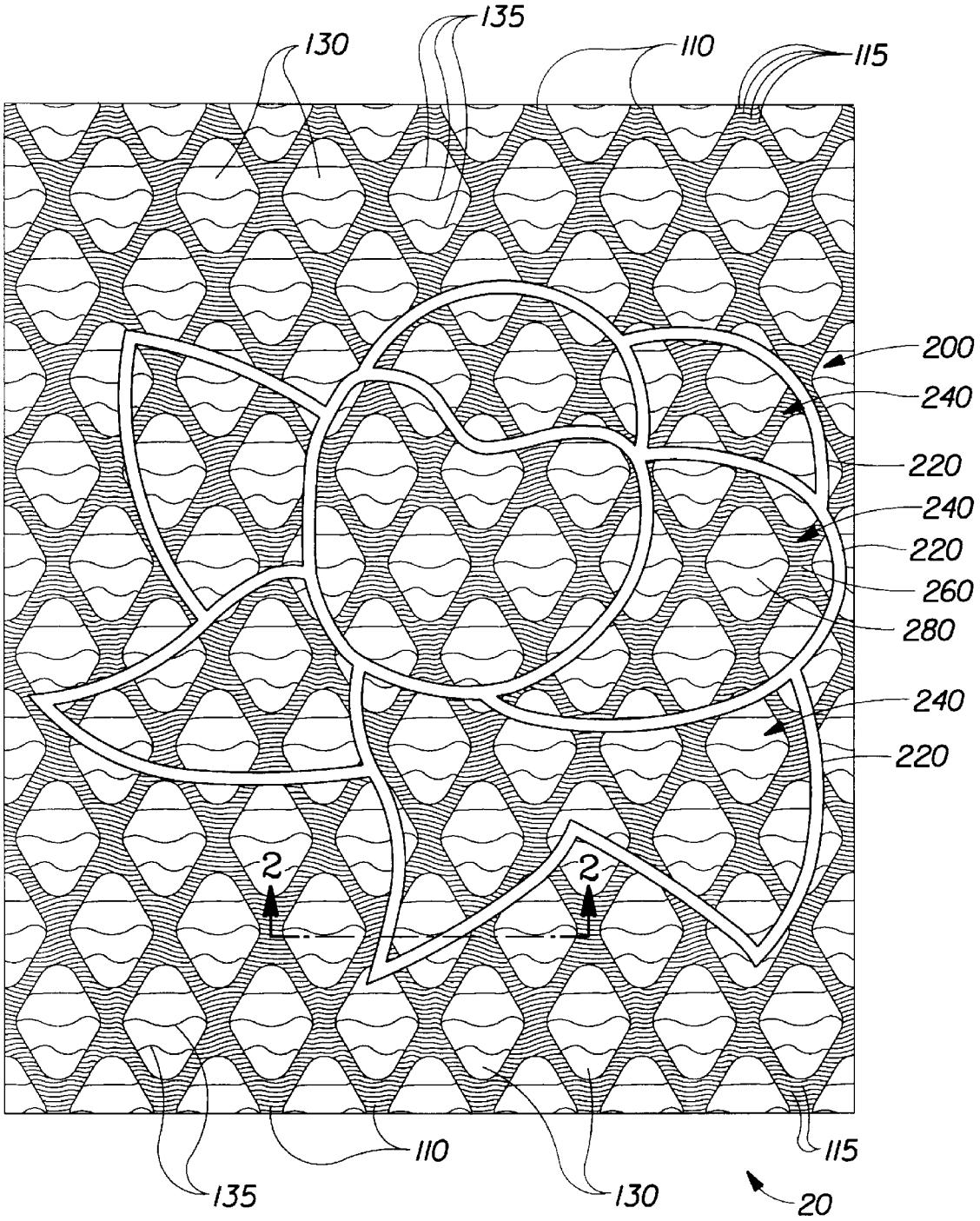
FIG. 1B is a enlarged plan view illustration of a single decorative indicia shown in FIG. 1A, and illustrating different crepe frequencies.
Figure 2:
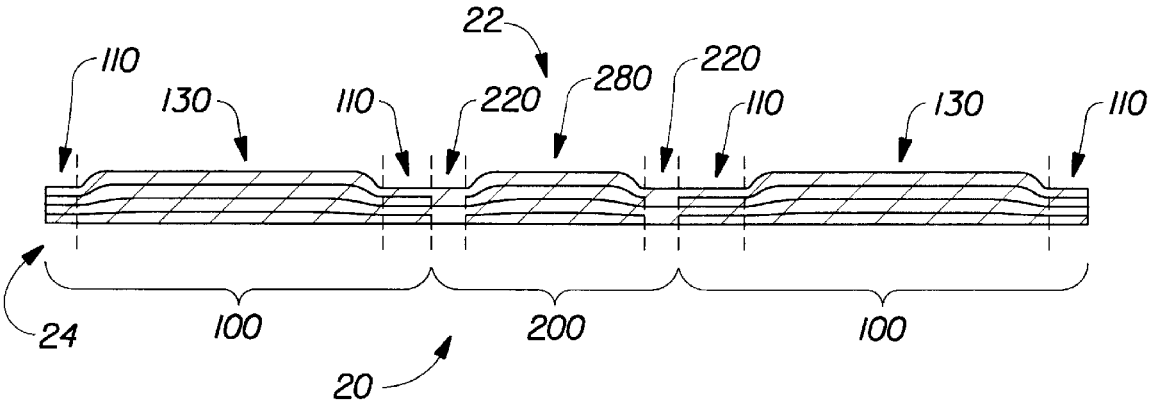
FIG. 2 is a cross-sectional schematic illustration of a paper web of the type shown in FIG. 1B and taken along lines 2—2 in FIG. 1B.

FIG. 2 is a cross-sectional illustration of a portion of a paper web of the type shown in FIGS. 1A and 1B. The line density through the web thickness in FIG. 2 is used to schematically illustrate the relative basis weights of different portions of the web. The portions of the web illustrated with 5 lines through the web thickness, e.g., regions 130, represent relatively high basis weight regions, and the portions of the web illustrated with 3 lines, e.g., regions 220, represent relatively low basis weight regions.

The paper web 20 includes a relatively high basis weight background portion 100. The paper web also includes discrete, visually distinctive decorative indicia 200 dispersed throughout the background portion 100 in a nonrandom, repeating pattern. The decorative indicia 200 can be imparted to the web by selective drainage of water from the web during formation of the web, as described in more detail below. The decorative indicia comprise one or more relatively low basis weight regions 220. The regions 220 have a basis weight which is lower than the basis weight of the surrounding background portion 100 of the paper web.

The relatively high basis weight background portion 100 is selectively densified to have at least one high density region and at least one low density region. In the embodiment shown in FIGS. 1A, 1B, and 2, the background portion 100 is selectively densified to have a relatively high density, continuous network region 110 and a plurality of discrete, relatively low density regions 130 dispersed throughout the continuous network region 110. The regions 130 are relatively thicker than the region 110.

The relatively low basis weight regions 220 can have a closed path shape outlining a plurality of adjacent, relatively higher basis weight cells 240. The basis weight everywhere within each of the cells 240 is higher than the basis weight of the relatively low basis weight regions 220 encircling the particular cell 240. Each cell 240 has a perimeter formed by a closed loop portion of the relatively low basis weight regions 220.

In one preferred embodiment, each cell 240 has no more than half its perimeter with any one adjacent cell 240.

Preferably, at least some cells 240 are characterized in having a perimeter such that any straight line drawn through the cell 240 intersects the perimeter of the cell in no more than three locations. Without being limited by theory, it is believed that such a cell geometery permits the decorative indicia 200 to be visually discernable and aesthetically pleasing without excessively reducing the strength of the web 20.

The relatively high basis weight cells 240 can be selectively densified to provide relatively high density regions and relatively low density regions. In FIGS. 1A and 1B, the relatively high basis weight cells 240 comprise a relatively high density, continuous network 260 and discrete, relatively low density regions 280 dispersed throughout the continuous network 260.

In one embodiment, the paper web 20 comprises between about 5 and about 5000 of the decorative indicia 200 per square meter of the web, and most preferably between about 25 and about 1000 decorative indicia 200 per square meter of the web, in order to enhance the distinction between the background 100 and the decorative indicia 200. The relatively high basis weight background portion 100 of the web can comprise at least about 10,000 relatively low density regions 130 per square meter of the web, the relatively thicker low density regions being dispersed throughout the continuous network region 110 to enhance the web's absorbency and bulk.

The background portion 100 has a smoothness value of less than about 900 on at least one of the oppositely facing surfaces of the web. In FIG. 2, the smoothness value of surface 24 is less than the smoothness value of surface 22. The smoothness value of surface 24 is preferably less than about 900. In particular, the paper web 20 can have surface smoothness ratio greater than about about 1.15, more preferably greater than about 1.20, even more preferably greater than about 1.25, still more preferably greater than about 1.30, and most preferably greater than about 1.40, where the surface smoothness ratio is the value of the surface smoothness of surface 22 divided by the value of the smoothness value of surface 24.

In one embodiment, the surface 24 of the web 20 can have a surface smoothness value of less than about 900, and more preferably less than about 850. The opposite surface 22 can have a surface smoothness value of at least about 900, and more preferably at least about 1000.

The method for measuring the value of the surface smoothness of a surface is described below under "Surface Smoothness." The value of surface smoothness for a surface increases as the surface becomes more textured and less smooth. Accordingly, a relatively low value of surface smoothness indicates a relatively smooth surface.

The regions 220 can have a basis weight which is less than about 75 percent of the basis weight of the surrounding background portion 100. The relatively low basis weight regions 220 can have a basis weight which is between about 25 percent and about 75 percent of the basis weight of the background portion 100.

In one embodiment, the regions 220 can have a basis weight which is less than about 60 percent of the basis weight of the surrounding background portion 100. The basis weight of the background portion 100 can be between about 10 grams per square meter and about 70 grams per square meter. The basis weight of the relatively low basis weight regions 220 can be between about 5 grams/square meter and about 35 grams/square meter.

The basis weight of the relatively low basis regions 220 is prefereably less than about 20 grams/square meter and more preferably less than about 15 grams/square meter. In one embodiment, the basis weight of the background portion 100 can be between about 10 grams/square meter and about 30 grams/square meter, and the basis weight of the relatively low basis weight regions 220 can be between about 5 grams/square meter and about 15 grams/square meter. The basis weight of the regions 240 can be about equal to the basis weight of the background portion 100.

The paper web of the present invention has the advantage that the decorative indicia provide consumer preferred aesthetics, yet the paper web maintains strength and absorbency of multi-density paper. Moreover, the paper webs of the present invention have decorative indicia and multi-density regions, yet can have a relatively smooth surface. The smooth surface provides consumer preferred softness. Additionally, the smooth surface surrounding the low basis weight decorative indicia accentuates the distinctiveness of the relatively low basis weight decorative indicia, thereby enhancing the aesthetic appearance of the web.

The continuous network region 110 and the discrete regions 130 can both be foreshortened, such as by creping. In FIG. 1B, the crepe ridges of the continuous network region 110 are designated by numeral 115, and extend in a generally cross-machine direction. Similarly, the discrete, relatively lower density and relatively thicker regions 130 can also be foreshortened to have crepe ridges 135.

The continuous network region 110 can be a relatively high density, macroscopically monoplanar continuous network region of the type disclosed in U.S. Pat. No. 4,637,859. The relatively lower density and relatively thicker regions 130 can be bilaterally staggered, as disclosed in U.S. Pat. No. 4,637,859. However, the regions 130 are not domes of the type shown in U.S. Pat. No. 4,637,859. The regions 130 are disposed in the plane of the continuous network region 110, as disclosed in U.S. patent application Ser. No. 08/748,871 "Paper Web Having A Relatively Thinner Continuous Network Region & Discrete Relatively Thicker Regions In the Plane of the Continuous Network Region", filed Nov. 14, 1996 in the name of Phan, which application is incorporated herein by reference.

The paper web 20 having the relatively smooth surface 24 can be useful in making a multiple ply tissue having smooth outwardly facing surfaces. For instance, two or more webs 20 can be combined to form a multiple ply tissue, such that the two outwardly facing surfaces of the multiple ply tissue comprise the surfaces 24 of the webs 20, and the surfaces 22 of the outer plies face inwardly. Alternatively, a two ply paper structure can be made by joining a web 20 of the present invention with a conventionally formed and dried paper web. The web 20 can be joined to the conventional paper web such that the surface 24 faces outwardly.

The paper web 20 can have a basis weight of about 10 to about 70 grams per square meter. The paper web 20 can have a macro-caliper of at least about 0.1 mm, and more preferably at least about 0.2 millimeter and a bulk density of less than about 0.12 gram per cubic centimeter (basis weight divided by macro-caliper, multiplied by an appropriate conversion factor if units are not consistent). The procedures for measuring the basis weight, macro-caliper, and bulk density of a web are described below.

The paper web 20 of the type shown in FIGS. 1–2 can also have an absorbent capacity of at least about 15 grams per gram. The method for measuring the absorbent capacity is described below. Accordingly, the paper web 20 exhibits the absorbency benefits of high bulk paper webs, in combination with the benefits of a relatively smooth surface usually associated with conventional felt pressed tissue paper.

FIG. 3 is a photograph of surface 22 of a paper web 20 made according to the present invention, showing a decorative indicia 200, the continuous network 110 and the discrete, relatively lower density regions 130 of the background 100.

Papermaking Method Description

Figure 4:
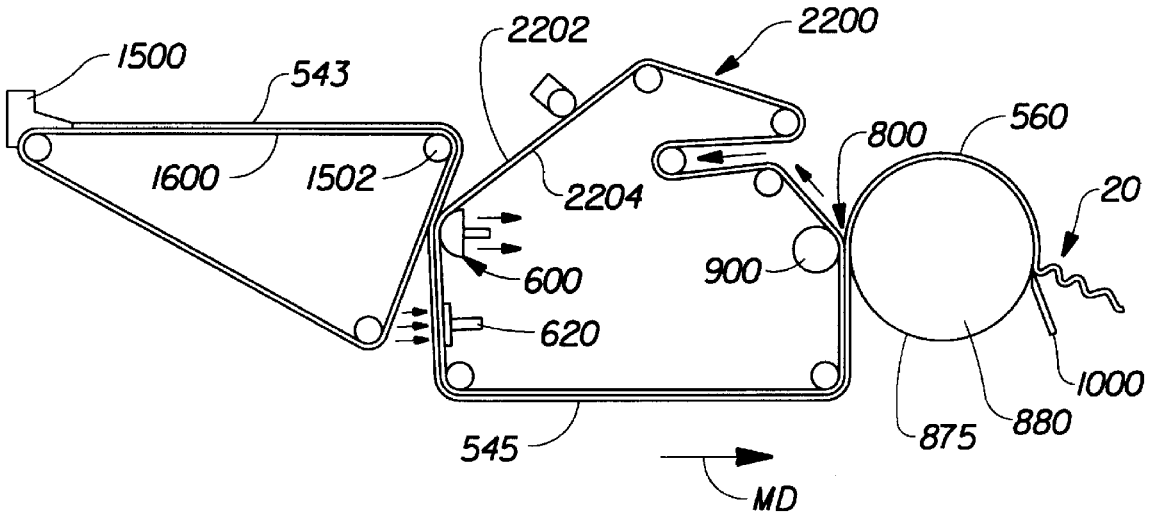
FIG. 4 is a schematic illustration of a paper machine which can be used to make the paper web of the present invention, the paper machine showing a paper web being formed on a forming element and selectively densified on a web support apparatus.

A paper structure 20 according to the present invention can be made with the papermaking apparatus shown in FIGS. 4. The method of making the paper structure 20 of the present invention is initiated by providing a plurality of fibers suspended in a liquid carrier, such as an aqueous dispersion of papermaking fibers in the form of a slurry, and depositing the slurry of papermaking fibers from a headbox 1500 onto a fiber retentive forming element 1600. The forming element 1600 is in the form of a continuous belt in FIG. 4. The slurry of papermaking fibers is deposited on the forming element 1600, and water is drained from the slurry through the forming element 1600 to form an embryonic web of papermaking fibers 543 supported by the forming element 1600. The slurry of papermaking fibers can include relatively long fibers having an average fiber length of greater than or equal to 2.0 mm, and relatively short fibers having an average fiber length of less than 2.0 mm. For instance, the relatively long fibers can comprise softwood fibers, and the relatively short fibers can comprise hardwood fibers. Hardwood and softwood fibers are discussed in more detail below.

Figure 5:
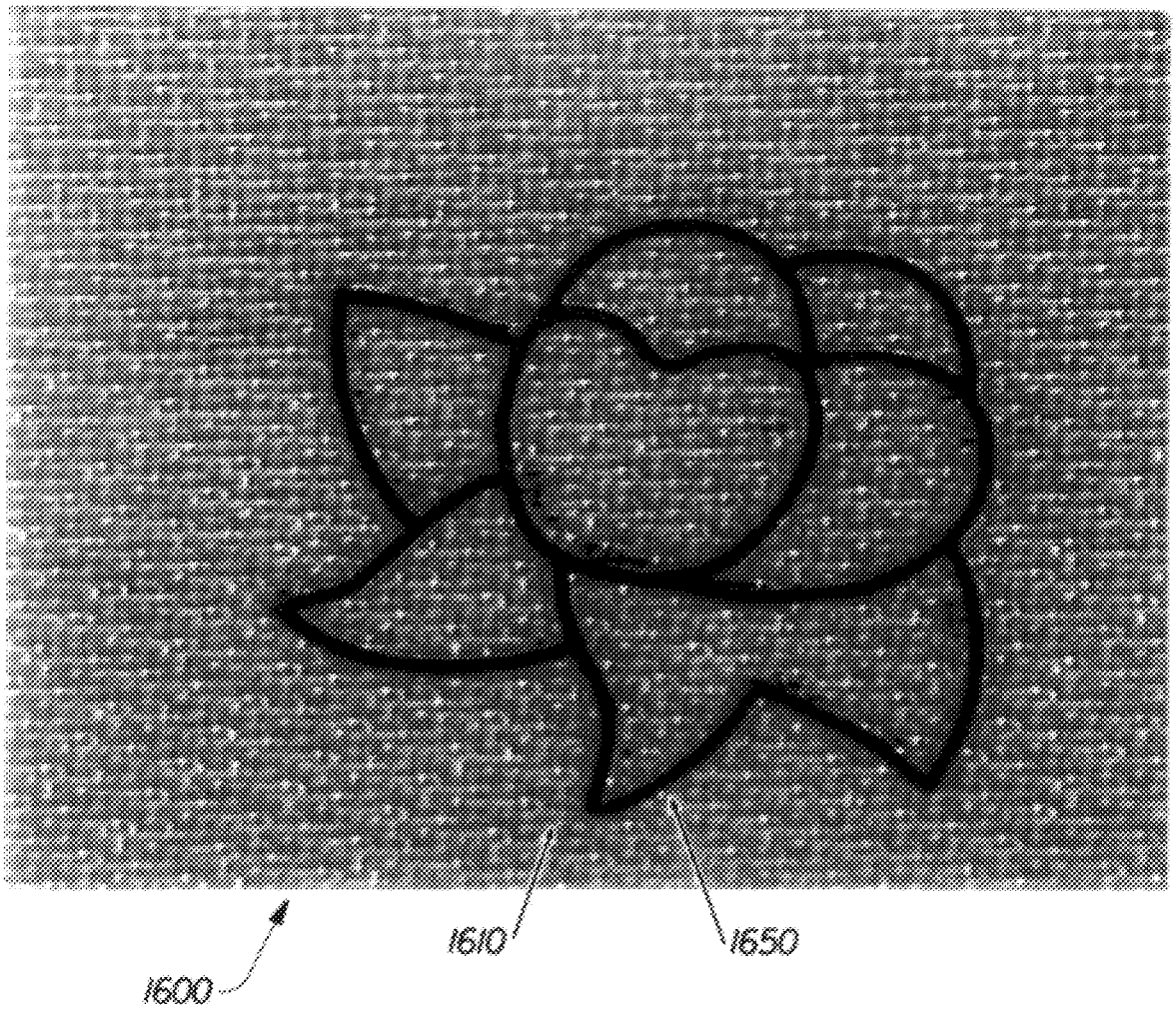
FIG. 5 is a photograph showing the sheet side of a forming element which can be used to make a paper web of the present invention, the forming element including a liquid permeable structure formed of woven filaments, and a patterned, liquid impermeable photopolymer resin layer joined to the woven filaments to form a flow restriction member corresponding to a decorative indicia.
Figure 6:
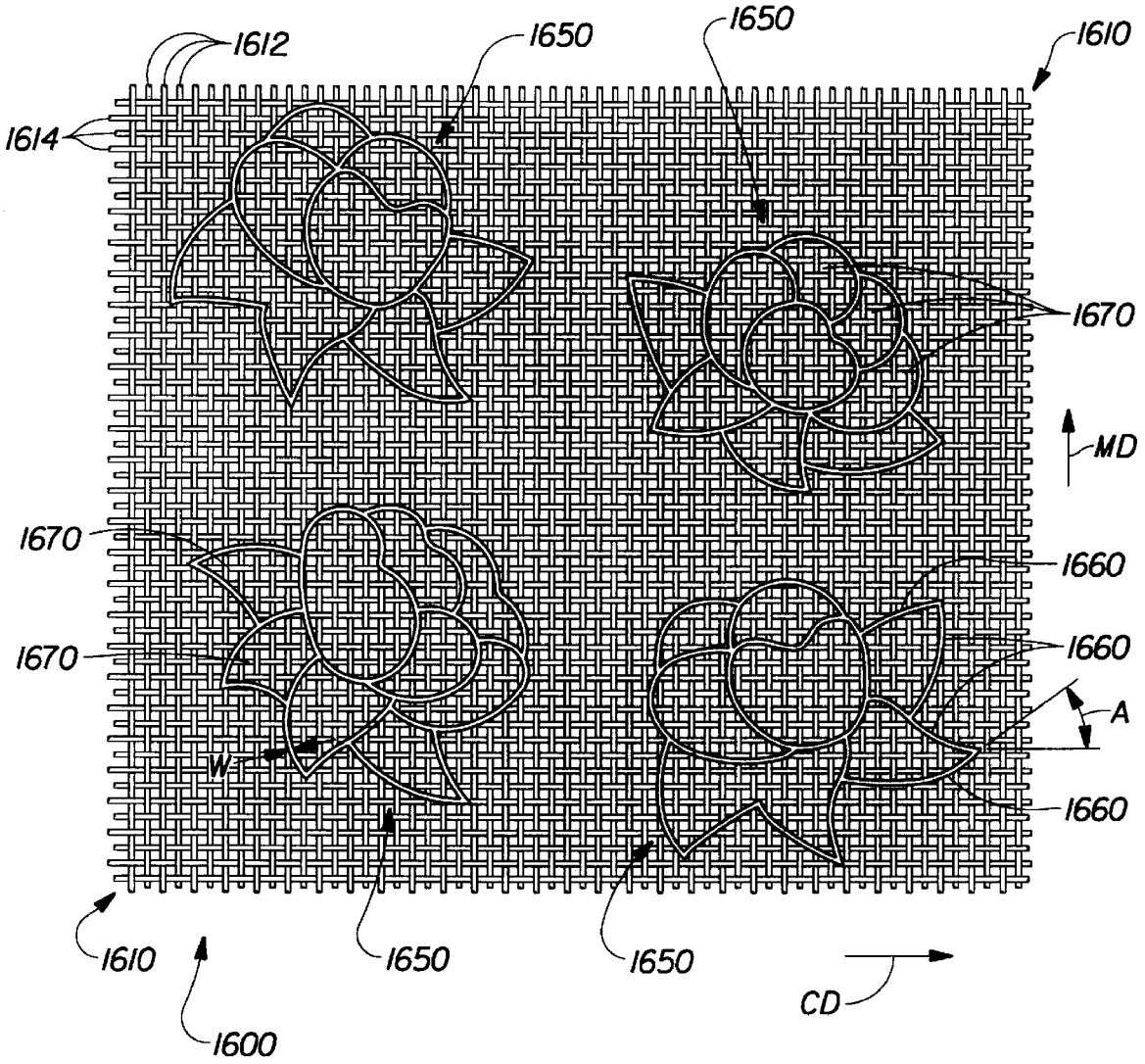
FIG. 6 is a plan view illustration of a portion of a forming element of the type shown in FIG. 5, the forming element in FIG. 6 including four flow restriction members.
Figure 7:
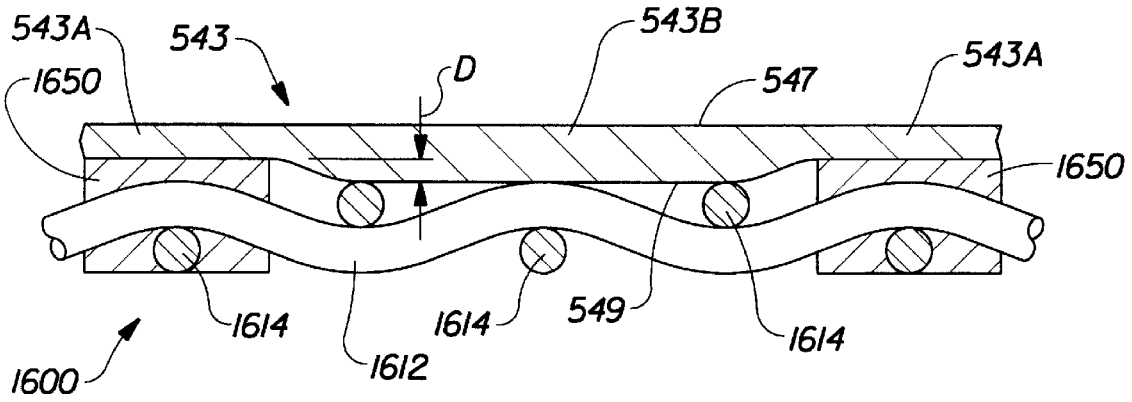
FIG. 7 is a cross-sectional schematic illustration showing an embryonic web supported on a forming element of the type shown in FIG. 6.

FIG. 5 is photograph of the web facing side of a forming element 1600 suitable for making a paper web 20 according to the present invention. FIG. 6 is a schematic illustration of the web facing side of a forming element 1600. FIG. 7 is a cross-sectional illustration of a forming element 1600 showing the embryonic web 543 deposited on the web facing side of the forming element 1600.

The forming element 1600 comprises a liquid permeable woven base 1610 and flow restriction members 1650 disposed on the woven base 1610. The woven base 1610 comprises machine direction filaments 1612 and cross-machine direction filaments 1614. The flow restriction members 1650 have a shape corresponding to the decorative indicia formed on the web 20. The woven base 1610 provides a first drainage zone corresponding to that portion of the woven base 1610 which is not covered by the flow restriction members 1650. The first drainage zone has a first drainage rate. The portion of the forming element 1600 on which the flow restriction members 1650 are disposed provides a second drainage zone having a second drainage rate slower than the first drainage rate.

The liquid carrier (e.g. water) is drained through the forming element 1600 in two simultaneous stages corresponding to the first and second drainage zones. Accordingly, fibers in the aqueous slurry tend to flow from the second drainage zone and accumulate in the first drainage zone, thereby forming relatively low basis weight regions in registration with the flow restriction members 1650. The relatively shorter fibers tend to accumulate in the first zone. At least some of the relatively longer fibers can bridge the width of the flow restriction members. As a result, the average fiber length of the papermaking fibers in the relatively low basis weight regions of the decorative indicia is greater than the average fiber length of the papermaking fibers in surrounding portions of the web.

The flow restriction members 1650 can be formed on the woven base by selectively curing a photopolymeric resin on the woven base 1610. Such flow restriction members 1650 are generally liquid impermeable, such that second drainage zone has a second drainage rate which is substantially zero. A suitable fiber retentive forming element 1600 can be formed with a photopolymeric resin as disclosed generally in U.S. Pat. No. 5,503,715 issued Apr. 2, 1996 in the name of Trokhan et al. and U.S. Pat. No. 5,534,326 issued Jul. 9, 1996 in the name of Trokhan et al, which patents are incorporated herein by reference.

The flow restriction members 1650 can be formed of a combination of linear and/or curvilinear segments 1660, which together form enclosed cells 1670. The segments 1660 have a width W (FIG. 6) measured generally perpendicular to the segment's length. If the web is formed of a single type of fiber, then the width W is preferably less than about half, and more preferably less than about one fourth of the average fiber length of the fibers. If the web is formed as a homogeneous mixture of different fiber types including hardwood and softwood fibers, the segments 1660 have a width W which is preferably less about half, and most preferably less than about one fourth of the average fiber length of the hardwood fibers forming the web. On the other hand, if the web comprises two or more layers, the width W should be less than about ½, and more preferably less than about ¼ the average fiber length of the hardwood fibers in the layer adjacent to the forming element 1600.

For instance, for a furnish made up of 100 percent Eucalyptus fibers, the width W should be less than about 0.5 millimeter, based on an average fiber length of about 1.0 mm. Alternatively, if the furnish is made up of 100 percent Northern Softwood Kraft fibers having an average fiber length of about 3.0 mm, then the width W should be less than about 1.5 mm.

The resulting decorative indicia can each comprise relatively low basis weight regions having a closed path shape completely encircling at least one relatively higher basis weight cell 240. The width of the relatively low basis weight regions (corresponding to the width W) as measured at any point along the closed path shape is between about 0.2 millimeter and about 2 millimeter.

The flow restriction members 1650 can have any suitable decorative shape, including but not limited to floral shapes, animal shapes, geometric shapes such as circles, squares, and triangles, and the like. Preferably, the segments 1660 of the flow restriction members 1650 are oriented on the forming element 1600 such that at least some of the segments 1660, and preferably the majority of the segments 1660, form an included angle A (FIG. 6) of at least about 15 degrees with respect to the Cross Machine Direction (CD in FIG. 6) Such orientation provides the advantage that the relatively low basis weight regions 220 are advantageously oriented with respect to the cross-machine direction of the paper web. As the web is creped from the dryer drum, the doctor blade is substantially parallel to the cross-machine direction of the paper web. As a result, the doctor blade impact is less likely to adversely affect the appearance and structure of the relatively low basis weight regions 220 if the segments 1660 are angled with respect to the cross-machine direction. In particular, if the relatively low basis weight regions are oriented to be substantially parallel to the cross-machine direction, it is believed that the doctor blade can "pick out" portions of the relatively low basis weight regions 220, thereby adversely affecting the decorative appearance of the web.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used. Alternatively, other non cellulosic fibers, such as synthetic fibers, can be used.

Both hardwood pulps and softwood pulps, either separately or together may be employed. The hardwood and softwood fibers can be blended, or alternatively, can be deposited in layers to provide a stratified web. U.S. Pat. No. 4,300,981 issued Nov. 17, 1981 to Carstens and U.S. Pat. No. 3,994,771 issued Nov. 30, 1976 to Morgan et al. are incorporated herein by reference for the purpose of disclosing layering of hardwood and softwood fibers.

The paper furnish can comprise a variety of additives, including but not limited to fiber binder materials, such as wet strength binder materials, dry strength binder materials, and chemical softening compositions. Suitable wet strength binders include, but are not limited to, materials such as polyamide-epichlorohydrin resins sold under the trade name of KYMENE® 557H by Hercules Inc., Wilmington, Del. Suitable temporary wet strength binders include but are not limited to synthetic polyacrylates. A suitable temporary wet strength binder is PAREZ® 750 marketed by American Cyanamid of Stanford, Conn.

Suitable dry strength binders include materials such as carboxymethyl cellulose and cationic polymers such as ACCO® 711. The CYPRO/ACCO family of dry strength materials are available from CYTEC of Kalamazoo, Mich.

The paper furnish deposited on the forming element 1600 can comprise a debonding agent to inhibit formation of some fiber to fiber bonds as the web is dried. The debonding agent, in combination with the energy provided to the web by the dry creping process, results in a portion of the web being debulked. In one embodiment, the debonding agent can be applied to fibers forming an intermediate fiber layer positioned between two or more layers. The intermediate layer acts as a debonding layer between outer layers of fibers. The creping energy can therefore debulk a portion of the web along the debonding layer.

As a result, the web can be formed to have a relatively smooth surface for efficient drying on a heated drying surface, such as the heated drying surface of a Yankee drying drum. Yet, because of the rebulking at the creping blade, the dried web can also have differential density regions, including a continuous network relatively high density region, and discrete relatively low density regions which are created by the creping process.

Suitable debonding agents include chemical softening compositions such as those disclosed in U.S. Pat. No. 5,279,767 issued Jan. 18, 1994 to Phan et al. Suitable biodegradable chemical softening compositions are disclosed in U.S. Pat. No. 5,312,522 issued May 17, 1994 to Phan et al. U.S. Pat. Nos. 5,279,767 and 5,312,522 are incorporated herein by reference. Such chemical softening compositions can be used as debonding agents for inhibiting fiber to fiber bonding in one or more layers of the fibers making up the web.

One suitable softener for providing debonding of fibers in one or more layers of fibers forming the web 20 is a papermaking additive comprising DiEster Di(Touch Hardened) Tallow Dimethyl Ammonium Chloride. A suitable softener is ADOGEN® brand papermaking additive available from Witco Company of Greenwich, Conn.

The embryonic web 543 is preferably prepared from an aqueous dispersion of papermaking fibers, though dispersions in liquids other than water can be used. The fibers are dispersed in the carrier liquid to have a consistency of from about 0.1 to about 0.3 percent. The percent consistency of a dispersion, slurry, web, or other system is defined as 100 times the quotient obtained when the weight of dry fiber in the system under consideration is divided by the total weight of the system. Fiber weight is always expressed on the basis of bone dry fibers.

The embryonic web 543 can be formed in a continuous papermaking process, as shown in FIG. 4, or alternatively, a batch process, such as a handsheet making process can be used. After the dispersion of papermaking fibers is deposited onto the forming element 1600, the embryonic web 543 is formed by removal of a portion of the aqueous dispersing medium through the forming element 1600 by techniques well known to those skilled in the art. Vacuum boxes, forming boards, hydrofoils, and the like are useful in effecting water removal from the aqueous dispersion of papermaking fibers to form embryonic web 543.

FIG. 7 shows an embryonic web being formed on the forming element 1600. The portions of the embryonic web supported on the flow restriction members 1650 are designated 543A, and the portions of the embryonic web supported on the woven base 1610 are designated 543B. The portions 543A correspond to the relatively low basis weight regions 220 in FIGS. 1A and 1B, and the portions 543B correspond to the relatively high basis weight background 100 and the cells 240 in FIGS. 1A and 1B.

The difference in elevation D between the top surface of the flow restriction members 1650 and the woven base 1610 is preferably less than about 6 mils (0.006 inch; 0.152 millimeter) in order to provide an generally monoplanar embryonic web 543 having substantially smooth first and second surfaces 547 and 549. More preferably, the difference in elevation D is less than about 3 mils. Preferably, the elevation D is preferably less than about ⅙ the average fiber length of the fibers in the web, and most preferably less than about ⅙ the average fiber length of the hardwood fibers in the web. The embryonic web 543 travels with the forming element 1600 about a return roll 1502 and is brought into the proximity of the web support apparatus 2200.

Referring to FIGS. 4, 8, 9, and 10, the next step in making the paper web 20 comprises transferring the embryonic web 543 from the forming element 1600 to the web support apparatus 2200, and supporting the transferred web (designated by numeral 545 in FIG. 4) on the first side 2202 of the apparatus 2200. The embryonic web preferably has a consistency of between about 5 and about 20 percent at the point of transfer to the web support apparatus 2200.

Figure 8:
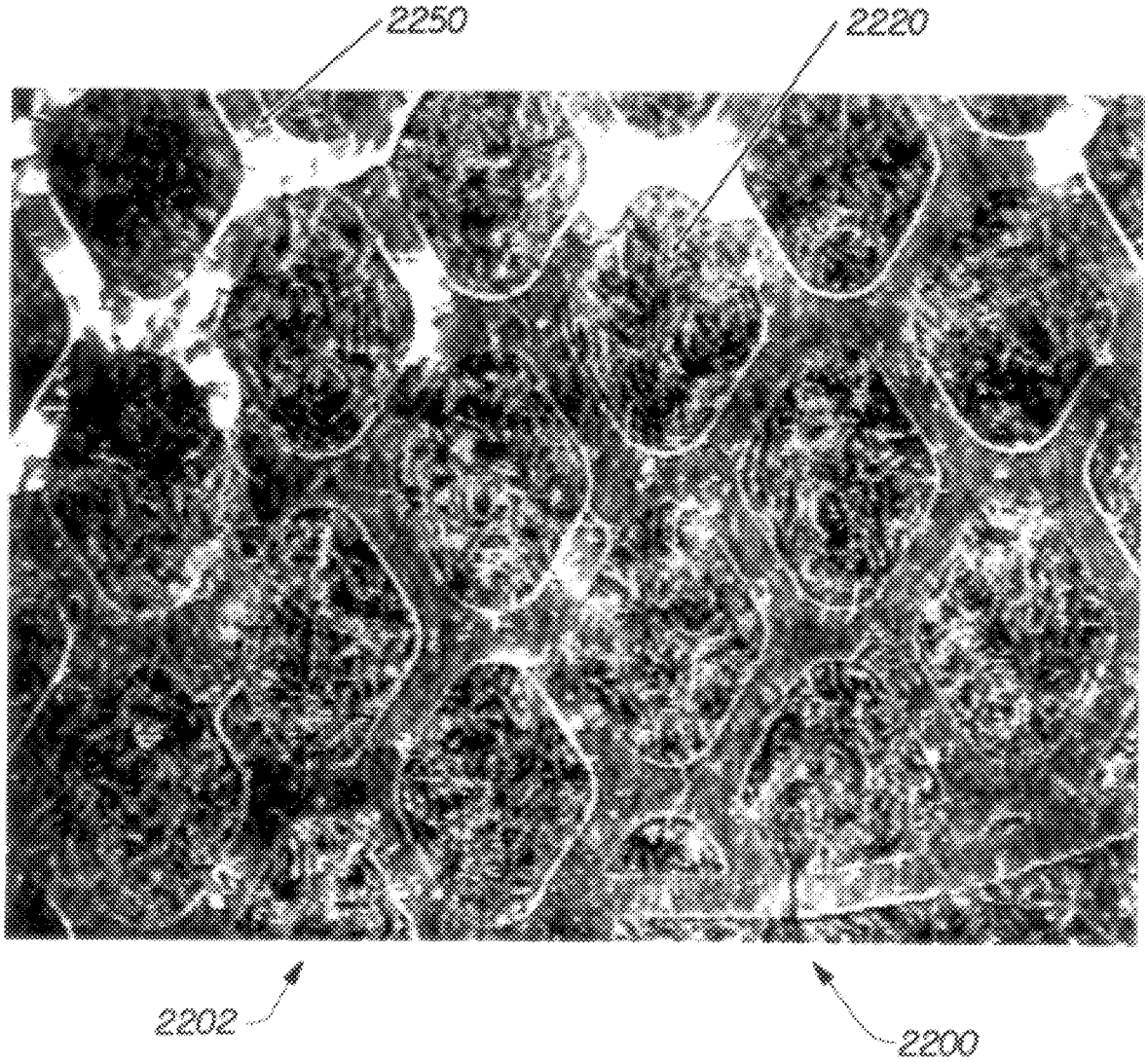
FIG. 8 is a photograph showing the sheet side surface of a web support apparatus in the form of a imprinting fabric comprising a felt layer and a patterned photopolymer layer joined to the felt layer to provide a continuous network web imprinting surface.
Figure 9:
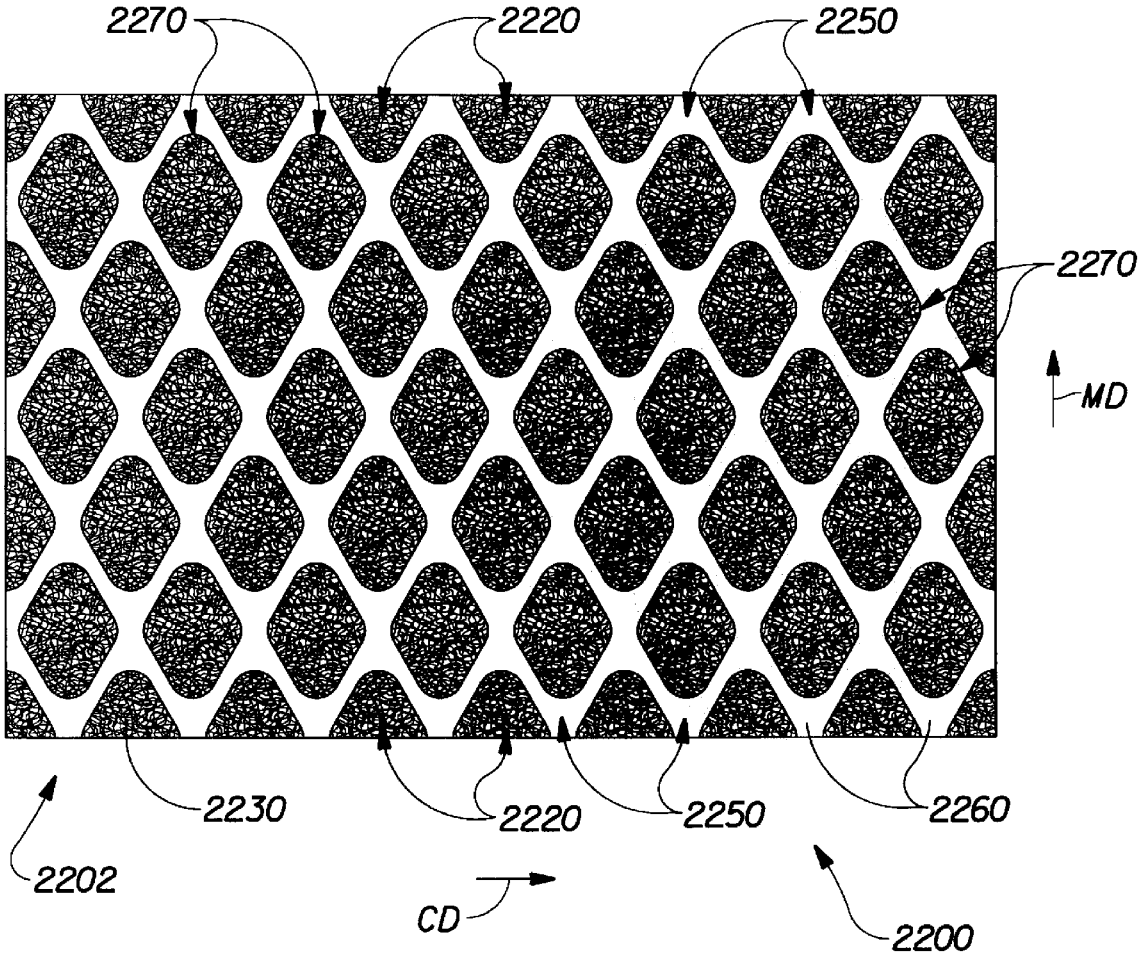
FIG. 9 is a plan view illustration of a portion of the sheet side of a web support apparatus of the type shown in FIG. 8.
Figure 10:
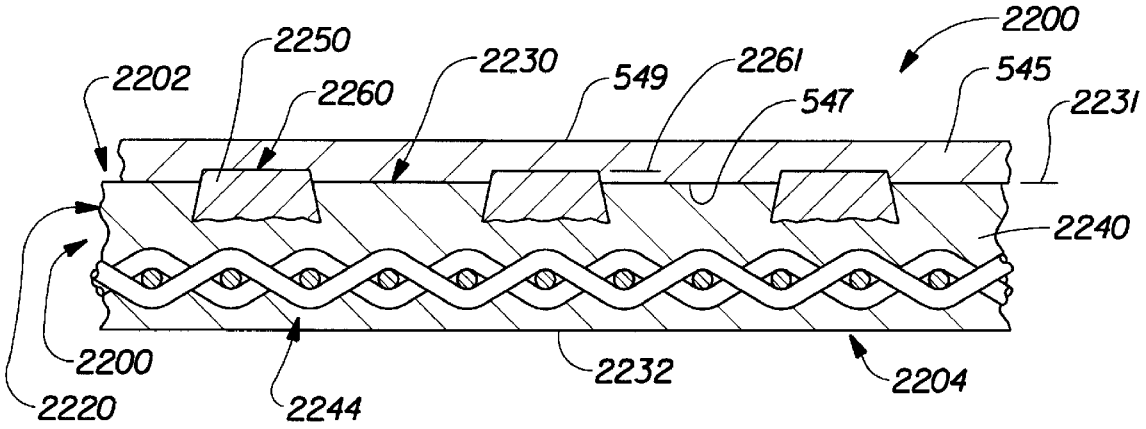
FIG. 10 is a cross-sectional schematic illustration showing the paper web transferred to the web support apparatus of the type shown in FIG. 9 to provide a paper web having a first surface conformed to the apparatus and a second substantially smooth surface.

Referring to FIGS. 8–10, the web support apparatus 2200 comprises a dewatering felt layer 2220 and a web patterning layer 2250. The web support apparatus 2200 can be in the form of a continuous belt for drying and imparting a pattern to a paper web on a paper machine. The web support apparatus 2200 has a first web facing side 2202 and a second oppositely facing side 2204. The web support apparatus 2200 is viewed with the first web facing side 2202 toward the viewer in FIGS. 8 and 9. The first web facing side 2202 comprises a first web contacting surface and a second web contacting surface.

In FIGS. 8 and 9, the first web contacting surface is a first felt surface 2230 of the felt layer 2220. The first felt surface 2230 disposed at a first elevation 2231. The first felt surface 2230 is a web contacting felt surface. The felt layer 2220 also has oppositely facing second felt surface 2232.

In FIGS. 8 and 9, the second web contacting surface is provided by the web patterning layer 2250. The web patterning layer 2250, which is joined to the felt layer 2220, has a web contacting top surface 2260 at a second elevation 2261. The difference between the first elevation 2231 and the second elevation 2261 is less than the thickness of the paper web when the paper web is transferred to the web support apparatus 2200. The surfaces 2260 and 2230 can be disposed at the same elevation, so that the elevations 2231 and 2261 are the same. Alternatively, surface 2260 can be slightly above surface 2230, or surface 2230 can be slightly above surface 2260.

The difference in elevation is greater than or equal to 0.0 mils and less than about 8.0 mils. In one embodiment, the difference in elevation is less than about 6.0 mils (0.15 mm), more preferably less than about 4.0 mils (0.10 mm), and most preferably less than about 2.0 mil (0.05 mm), in order to maintain a relatively smooth surface 24.

The dewatering felt layer 2220 is water permeable and is capable of receiving and containing water pressed from a wet web of papermaking fibers. The web patterning layer 2250 is water impervious, and does not receive or contain water pressed from a web of papermaking fibers. The web patterning layer 2250 can have a continuous web contacting top surface 2260, as shown in FIGS. 8 and 9. Alternatively, the web patterning layer can be discontinuous or semicontinuous.

The web patterning layer 2250 preferably comprises a photosensitive resin which can be deposited on the first surface 2230 as a liquid and subsequently cured by radiation so that a portion of the web patterning layer 2250 penetrates, and is thereby securely bonded to, the first felt surface 2230. The web patterning layer 2250 preferably does not extend through the entire thickness of the felt layer 2220, but instead extends through less than about half the thickness of the felt layer 2220 to maintain the flexibility and compressibility of the web support apparatus 2200, and particularly the flexibility and compressibility of the felt layer 2220.

A suitable dewatering felt layer 2220 comprises a nonwoven batt 2240 of natural or synthetic fibers joined, such as by needling, to a support structure formed of woven filaments 2244. Suitable materials from which the nonwoven batt can be formed include but are not limited to natural fibers such as wool and synthetic fibers such as polyester and nylon. The fibers from which the batt 2240 is formed can have a denier of between about 3 and about 20 grams per 9000 meters of filament length.

The felt layer 2220 can have a layered construction, and can comprise a mixture of fiber types and sizes. The felt layer 2220 is formed to promote transport of water received from the web away from the first felt surface 2230 and toward the second felt surface 2232. The felt layer 2220 can have finer, relatively densely packed fibers disposed adjacent the first felt surface 2230. The felt layer 2220 preferably has a relatively high density and relatively small pore size adjacent the first felt surface 2230 as compared to the density and pore size of the felt layer 2220 adjacent the second felt surface 2232, such that water entering the first surface 2230 is carried away from the first surface 2230.

The dewatering felt layer 2220 can have a thickness greater than about 2 mm. In one embodiment the dewatering felt layer 2220 can have a thickness of between about 2 mm and about 5 mm.

PCT Publications WO 96/00812 published Jan. 11, 1996, WO 96/25555 published Aug. 22, 1996, WO 96/25547 published Aug. 22, 1996, all in the name of Trokhan et al.; U.S. patent application 08/701,600 "Method for Applying a Resin to a Substrate for Use in Papermaking" filed Aug. 22, 1996; U.S. patent application 08/640,452 "High Absorbence/Low Reflectance Felts with a Pattern Layer" filed Apr. 30, 1996; and U.S. patent application 08/672,293 "Method of Making Wet Pressed Tissue Paper with Felts Having Selected Permeabilities" filed Jun. 28, 1996 are incorporated herein by reference for the purpose of disclosing applying a photosensitive resin to a dewatering felt and for the purpose of disclosing suitable dewatering felts.

The dewatering felt layer 2220 can have an air permeability of less than about 200 standard cubic feet per minute (scfm), where the air permeability in scfm is a measure of the number of cubic feet of air per minute that pass through a one square foot area of a felt layer, at a pressure differential across the dewatering felt thickness of about 0.5 inch of water. In one embodiment, the dewatering felt layer 2220 can have an air permeability of between about 5 and about 200 scfm, and more preferably less than about 100 scfm.

The dewatering felt layer 2220 can have a basis weight of between about 800 and about 2000 grams per square meter, an average density (basis weight divided by thickness) of between about 0.35 gram per cubic centimeter and about 0.45 gram per cubic centimeter. The air permeability of the web support apparatus 2200 is less than or equal to the permeability of the felt layer 2220.

One suitable felt layer 2220 is an Amflex 2 Press Felt manufactured by the Appleton Mills Company of Appleton, Wis. The felt layer 2220 can have a thickness of about 3 millimeter, a basis weight of about 1400 gm/square meter, an air permeability of about 30 scfm, and have a double layer support structure having a 3 ply multifilament top and bottom warp and a 4 ply cabled monofilament cross-machine direction weave. The batt 2240 can comprise polyester fibers having a denier of about 3 at the first surface 2230, and a denier of between about 10–15 in the batt substrate underlying the first surface 2230.

The web support apparatus 2200 shown in FIG. 9 has a web patterning layer 2250 having a continuous network web contacting top surface 2260 having a plurality of discrete openings 2270 therein. Suitable shapes for the openings 2270 include, but are not limited to circles, ovals elongated in the machine direction (MD in FIG. 9), polygons, irregular shapes, or mixtures of these. The projected surface area of the continuous network top surface 2260 can be between about 5 and about 75 percent of the projected area of the web support apparatus 2200 as viewed in FIG. 9, and is preferably between about 25 percent and about 50 percent of the projected area of the apparatus 2200.

The continuous network top surface 2260 can have at least about 10,000, and more preferably at least about 50,000 discrete openings 2270 per square meter of the projected area of the apparatus 2200, and more preferably at least about 15,000 discrete openings 2270 per square meter of the apparatus 2200 as viewed in FIG. 9. In one embodiment, the continuous network top surface 2260 has at least about 100,000 discrete openings 2270 per square meter.

The discrete openings 2270 can be bilaterally staggered in the machine direction (MD) and cross-machine direction (CD) as described in U.S. Pat. No. 4,637,859 issued Jan. 20, 1987, which patent is incorporated herein by reference. Alternatively, the other photopolymer patterns can be used for providing different patterns of densification of the web.

The web is transferred to the web support apparatus 2200 such that the first face 547 of the transferred web 545 is supported on and conformed to the side 2202 of the apparatus 2200, with parts of the web 545 supported on the surface 2260 and parts of the web supported on the felt surface 2230. The second face 549 of the web is maintained in a substantially smooth, macroscopically monoplanar configuration. Referrring to FIG. 10, the elevation difference between the surface 2260 and the surface 2230 of the web support apparatus 2200 is sufficiently small that the second face of the web remains substantially smooth and macroscopically monoplanar when the web is transferred to the apparatus 2200. In particular, the difference in elevation between the surface 2260 and the surface 2230 should be smaller than the thickness of the embryonic web at the point of transfer.

The steps of transferring the embryonic web 543 to the apparatus 2200 can be provided, at least in part, by applying a differential fluid pressure to the embryonic web 543. Referring to FIG. 4, the embryonic web 543 can be vacuum transferred from the forming element 1600 to the apparatus 2200 by a vacuum source 600 depicted in FIG. 4, such as a vacuum shoe or a vacuum roll. One or more additional vacuum sources 620 can also be provided downstream of the embryonic web transfer point to provide further dewatering.

Figure 11:
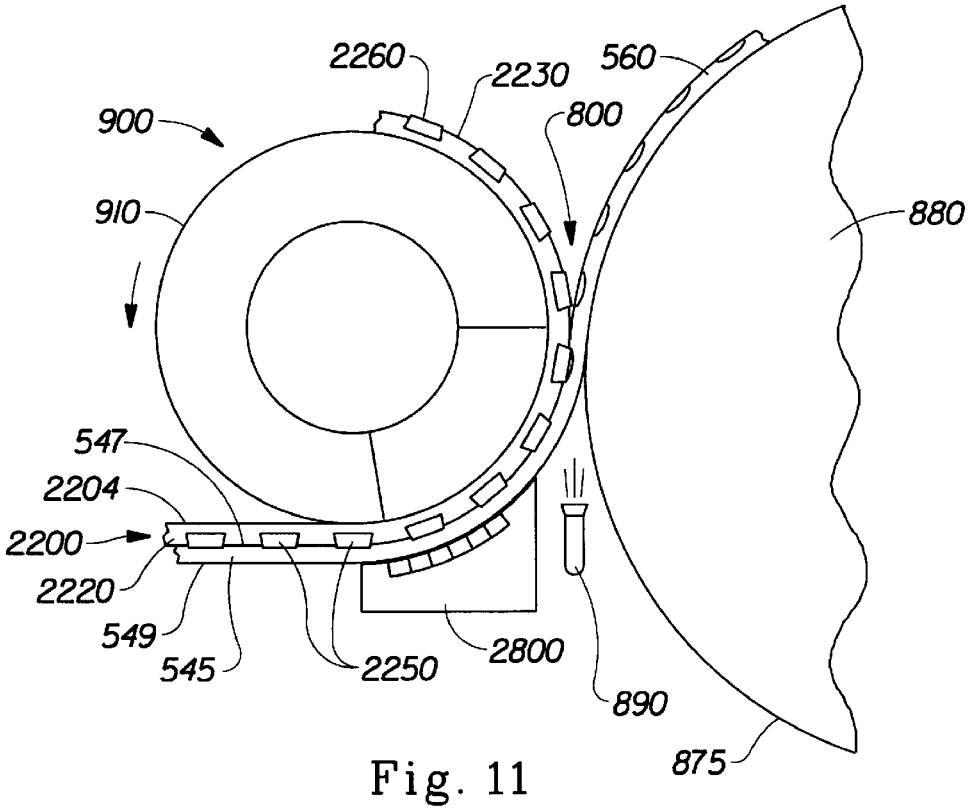
FIG. 11 is a schematic illustration showing a paper web being transferred to a Yankee dryer.

The web 545 is carried on the apparatus 2200 in the machine direction (MD in FIG. 4) to a nip 800 provided between a vacuum pressure roll 900 and a hard surface 875 of a heated Yankee dryer drum 880. Referring to FIG. 11, a steam hood 2800 can be positioned just upstream of the nip 800. The steam hood can be used to direct steam onto the surface 549 of the web 545 as the surface 547 of the web 545 is carried over the vacuum pressure roll 900.

The steam hood 2800 is mounted opposite a section of the vacuum providing portion 920 of the vacuum pressure roll. The vacuum providing portion 920 draws the steam into the web 545 and the felt layer 2220. The steam provided by steam hood 2800 heats the water in the paper web 545 and the felt layer 2220, thereby reducing the viscosity of the water in the web and the felt layer 2220. Accordingly, the water in the web and the felt layer 2220 can be more readily removed by the vacuum provided by roll 900.

The steam hood 2800 can provide about 0.3 pound of saturated steam per pound of dry fiber at a pressure of less than about 15 psi. The vacuum providing portion 920 provides a vacuum of between about 1 and about 15 inches of Mercury, and preferably between about 3 and about 12 inches of Mercury at the surface 2204.

A suitable vacuum pressure roll 900 is a suction pressure roll manufactured by Winchester Roll Products. A suitable steam hood 2800 is a model D5A manufactured by Measurex-Devron Company of North Vancouver, British Columbia, Canada.

The vacuum providing portion 920 is in communication with a source of vacuum (not shown). The vacuum providing portion 920 is stationary relative to the rotating surface 910 of the roll 900. The surface 910 can be a drilled or grooved surface through which vacuum is applied to the surface 2204. The surface 910 rotates in the direction shown in FIG. 11. The vacuum providing portion 920 provides a vacuum at the surface 2204 of the web support apparatus 2200 as the web and apparatus 2200 are carried through the steam hood 2800 and through the nip 800. While a single vacuum providing portion 920 is shown, in other embodiments it may be desirable to provide separate vacuum providing portions, each providing a different vacuum at the surface 2204 as the apparatus 2200 travel around the roll 900.

The Yankee dryer typically comprises a steam heated steel or iron drum. Referring to FIG. 11, the web 545 is carried into the nip 800 supported on the apparatus 2200, such that the substantially smooth second face 549 of the web can be transferred to the surface 875. Upstream of the nip, prior to the point where the web is transferred to the surface 875, a nozzle 890 applies an adhesive to the surface 875.

The adhesive can be a polyvinyl alchohol based adhesive. Alternatively, the adhesive can be CREPTROL® brand adhesive manufactured by Hercules Company of Wilmington Del. Other adhesives can also be used. Generally, for embodiments where the web is transferred to the Yankee drum 880 at a consistency greater than about 45 percent, a polyvinyl alchohol based creping adhesive can be used. At consistencies lower than about 40 percent, an adhesive such as the CREPTROL® adhesive can be used.

The adhesive can be applied to the web directly, or indirectly (such as by application to the Yankee surface 875), in a number of ways. For instance, the adhesive can be sprayed in micro-droplet form onto the web, or onto the Yankee surface 875. Alternatively, the adhesive could also be applied to the surface 875 by a transfer roller or brush. In yet another embodiment, the creping adhesive could be added to the paper furnish at the wet end of the papermachine, such as by adding the adhesive to the paper furnish in the headbox 500. From about 2 pounds to about 4 pounds of adhesive can be applied per ton of paper fibers dried on the Yankee drum 880.

As the web is carried on the apparatus 2200 through the nip 800, the vacuum providing portion 920 of the roll 900 provides a vacuum at the surface 2204 of the web support apparatus 2200. Also, as the web is carried on the apparatus 2200 through the nip 800, between the vaccuum pressure roll 900 and the dryer surface 800, the web patterning layer 2250 of the web support apparatus 2200 imparts the pattern corresponding to the surface 2260 to the first face 547 of the web 545. Because the second face 549 is a substantially smooth, macroscopically monoplanar face, substantially all of the of the second surface 549 is positioned against, and adhered to, the dryer surface 875 as the web is carried through the nip 800. As the web is carried through the nip, the second face 549 is supported against the smooth surface 875 to be maintained in a substantially smooth, macroscopically monoplanar configuration. Accordingly, a predetermined pattern can be imparted to the first face 547 of the web 545, while the second face 549 remains substantially smooth. The web 545 preferably has a consistency of between about 20 percent and about 60 percent when the web 545 is transferred to the surface 875 and the pattern of surface 2260 is imparted to the web to selectively densify the web. The pattern of the surface 2260 is imparted to the web to provide the continuous network region 110 and the discrete, relatively low density regions 130 shown in FIG. 1A and FIG. 1B.

Without being limited by theory, it is believed that, as a result of having substantially all of the second face 549 positioned against the Yankee surface 875, drying of the web 545 on the Yankee is more efficient than would be possible with a web which has only selective portions of the second face against the Yankee.

In particular, it is believed that positioning substantially all of the second face 549 against the Yankee permits a web 545 having a basis weight of at least about 8 pounds per 3000 square feet (13 grams/square meter), and more preferably at least about 10 pounds per 3000 square feet (16.3 grams/square meter) to be dried from a relatively low consistency to a relatively high consistency on the Yankee drum at a relatively high Yankee drum speed. Further, it is believed such a web 545 having the above basis weight characteristics can be dried from a consistency of less than about 30 percent and more preferably less than about 25 percent (when the web is transferred to the drum 880), to a consistency of at least about 90 percent, and more preferably at least about 95 percent (when the web is removed from the drum by creping) at a relatively high web speed which permits economical production of the paper web 20.

In comparison, it is believed that for the same drying conditions and dryer design, the Yankee dryer speed for drying paper having a continuous network and discrete domes as disclosed in U.S. Pat. No. 4,637,859 and a basis weight of at least about 10 pounds per 3000 square feet can be limited due to the tendency of the domes to not dry as rapidly as the continuous network.

The final step in forming the paper structure 20 comprises creping the web 545 from the surface 875 with a doctor blade 1000, as shown in FIG. 4. Without being limited by theory, it is believed that the energy imparted by the doctor blade 1000 to the web 545 bulks, or de-densifies, at least some portions of the web, especially those portions of the web which are not imprinted by the web patterning surface 2260, such as relatively low density regions 130 and 280. Accordingly, the step of creping the web from the surface 875 with the doctor blade 1000 provides a web having a first, compacted, relatively thinner region corresponding to the pattern imparted to the first face of the web, and a second relatively thicker region. In one embodiment, the doctor blade has a bevel angle of about 25 degrees and is positioned with respect to the Yankee dryer to provide an impact angle of about 81 degrees.

The paper structure 20 shown in FIGS. 1B and 3 exhibits forshortening due to creping in both the relatively high density, continuous network region 110 and the relatively low density, discrete regions 130. The creping frequency in the region 110 can be different than the creping frequency in the regions 130. Generally, the creping frequency in the regions 130 is lower than the creping frequency in the continuous network 110. This difference in crepe frequency is illustrated in FIG. 1B, where the crepe ridges 115 are more closely spaced together (higher frequency) than are the crepe ridges 135.

Accordingly, the paper web 20 provides decorative aesthetics imparted by the decorative indicia 200 without the need for embossing. Further, the web 20 exhibits flexibility provided by creping in both high and low density regions, bulk and absorbency provided by the low density regions 130 and 280, and softness provided by the relatively smooth surface 24.

Figure 14:
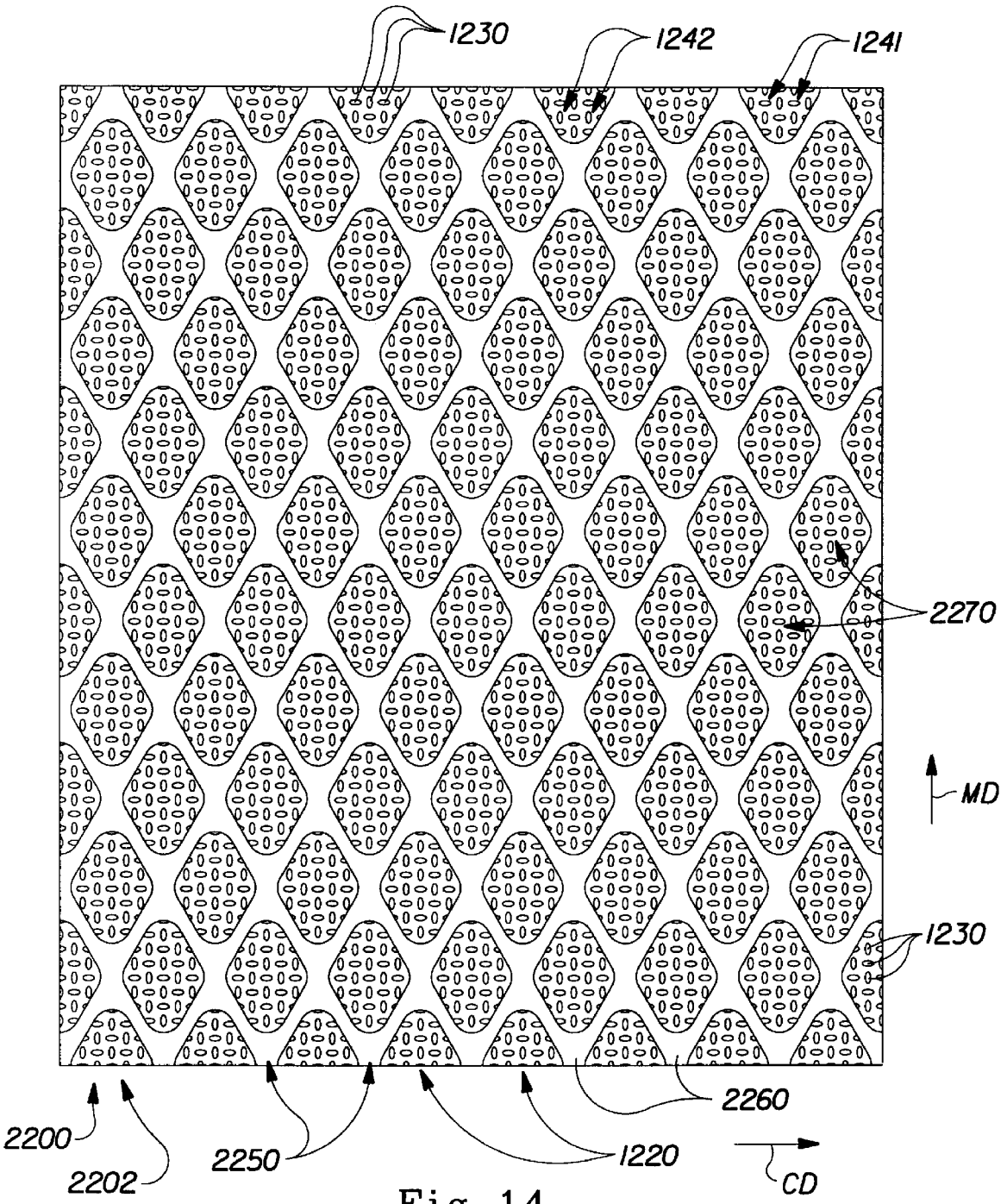
FIG. 14 is a plan view illustration of an apparatus for use in making a paper web of the type illustrated in FIG. 12, the apparatus comprising a web patterning layer joined to foraminous element formed of woven filaments.

In another alternative embodiment of the present invention, the web support apparatus 2200 can comprise a resin layer disposed on a foraminous background element comprising a fabric of woven filaments. Referring to FIGS. 14–18, the apparatus 2200 can comprise a resin layer 2250 disposed on a woven fabric 1220. The resin layer 2250 has a continuous network web contacting surface 2260 defining discrete openings 2270, as shown in FIG. 14. The woven fabric 1220 comprises machine direction filaments 1242 and cross machine direction filaments 1241. The apparatus 2200 has a first side 2202 and a second side 2204. The first side 2202 includes first and second web contacting surfaces.

Figure 15:
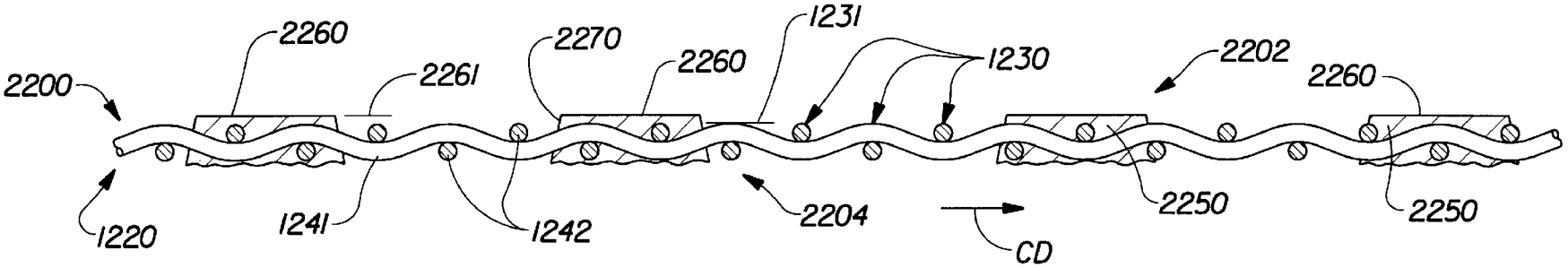
FIG. 15 is a cross-sectional illustration of the apparatus of FIG. 14.

In FIGS. 14 and 15, the first web contacting surface at a first elevation 1231 is provided by discrete knuckle surfaces 1230 located at cross-over points of the filaments 1241 and 1242. The top surfaces of the filaments 1241 and 1242 can be sanded or otherwise ground to provide relatively flat, generally oval shaped knuckle surfaces 1230. The second web contacting surface is provided by the web patterning layer 2250. The web patterning layer 2250, which is joined to the woven fabric 1220, has a web contacting top surface 2260 at a second elevation 2261.

The difference between the first elevation 1231 and the second elevation 2261 is less than the thickness of the paper web when the paper web is transferred to the web support apparatus 2200. The continuous surface 2260 and the discrete surfaces 1230 can be disposed at the same elevation, so that the elevations 1231 and 2261 are the same. Alternatively, surface 2260 can be slightly above the surfaces 1230, or surfaces 1230 can be slightly above surface 2260.

The difference in elevation is greater than or equal to 0.0 mils and less than about 5.0 mils. In one embodiment, the difference in elevation is less than about 4.0 mils (0.10 mm), more preferably less than about 2.0 mils (0.05 mm), and most preferably less than about 1.0 mil (0.025 mm), in order to maintain a relatively smooth surface 24 of the dried web.

Figure 12:
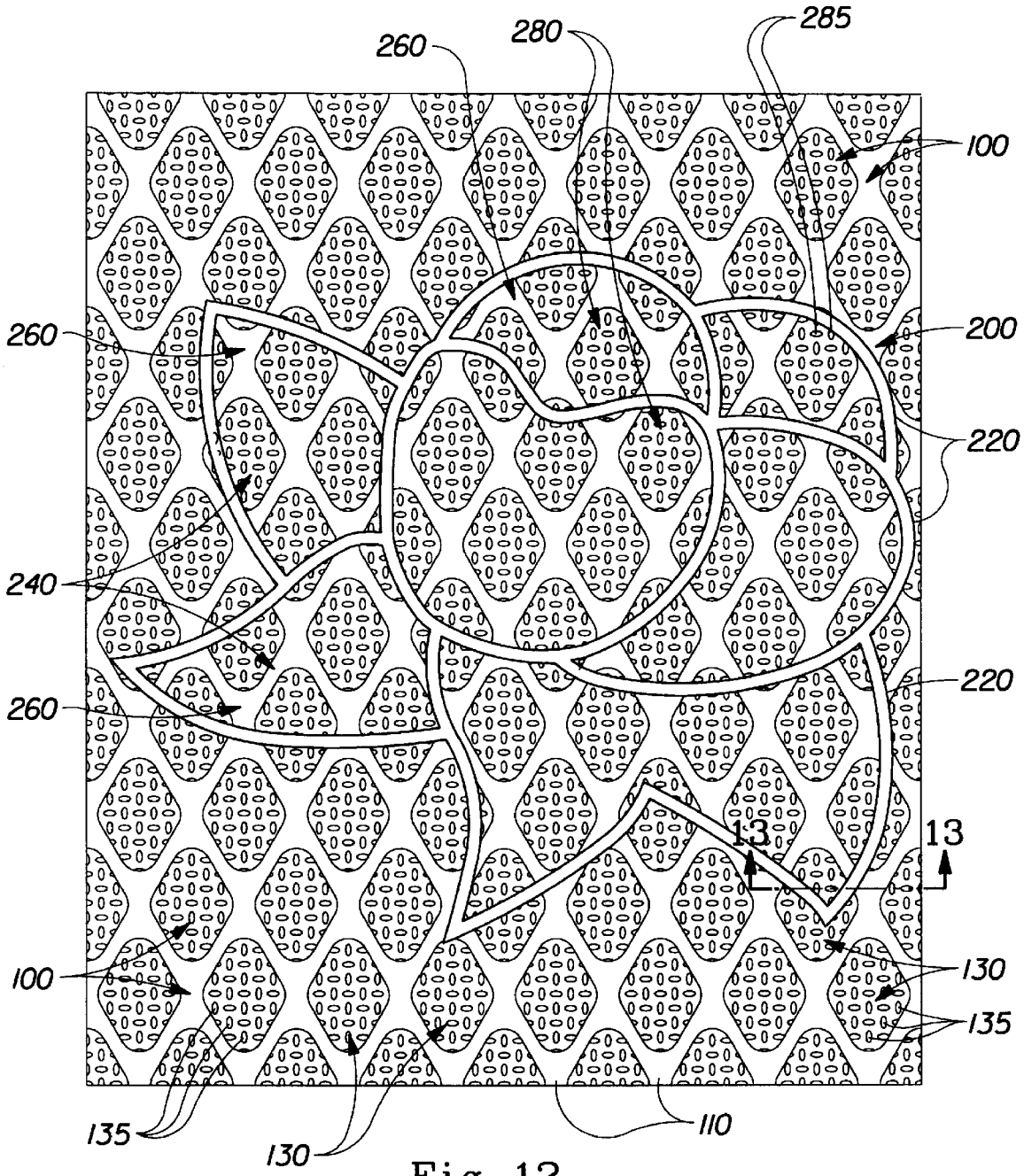
FIG. 12 is a plan view illustration of a paper web made according to an alternative embodiment of the present invention, the paper web including discrete, decorative indicia, and a relatively high basis weight background comprising a continuous network region, discrete relatively low density regions dispersed throughout the network, and discrete, relatively high density regions dispersed throughout each of the relatively low density regions.
Figure 13:
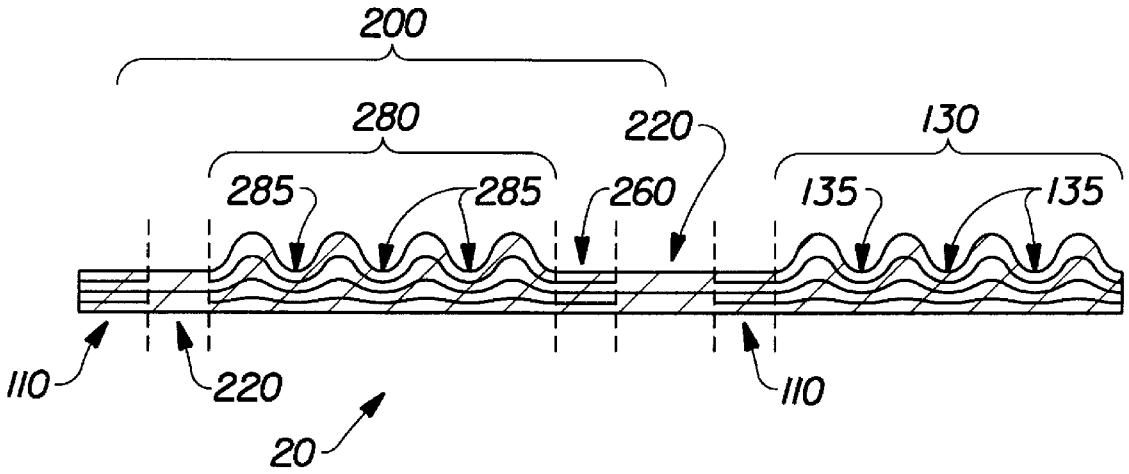
FIG. 13 is a cross-sectional illustration of the paper web of FIG. 12 taken along lines 13—13 in FIG. 12.

The web support apparatus 2200 shown in FIGS. 14 and 15 can be used to form the paper web shown in FIGS. 12 and 13. FIG. 12 is a plan view illustration of a paper web 20 according to an alternative embodiment of the present invention. FIG. 13 is a cross-sectional illustration of a paper web of the type illustrated in FIG. 12.

Referring to FIGS. 12 and 13, the paper web 20 has a background portion 100 and decorative indicia 200 comprising relatively low basis weight regions 220. The background portion 100 comprises a relatively high density continuous network 110, and discrete, relatively lower density regions 130 dispersed throughout the continuous network region 110. One or more discrete, relatively high density region 135 is dispersed throughout each of the relatively lower density regions 130.

The relatively low basis weight regions 220 can have a closed path shape outlining a plurality of adjacent, relatively higher basis weight cells 240 (seven cells 240 in FIG. 12). The basis weight everywhere within each of the cells 240 is higher than the basis weight of the regions 220 encircling the particular cell 240. Each cell 240 has a perimeter formed by a closed loop portion of the relatively low basis weight regions 220. The cells 240 can be selectively densified to comprise a relatively high density, continuous network 260 and discrete, relatively low density regions 280 dispersed throughout the continuous network 260. Each discrete relatively low density region 280 encircles a plurality of discrete, relatively higher density regions 285.

The continuous networks 110 and 260 and correspond to the surface 2260 of the web support apparatus 2200 shown in FIG. 14. The discrete, relatively high density regions 135 and 285 correspond to the surfaces 1230 shown in FIG. 14. The relatively lower density regions 130 and 280 of the web in FIG. 12 correspond to those portions of the web which are not registered with either the surface 2260 or the surfaces 1230.

FIG. 13 is a cross-sectional view of a portion of a paper web of the type shown in FIG. 12. The line density through the web thickness in FIG. 13 is used to schematically illustrate the relative basis weights of different portions of the web. The portions of the web illustrated with 5 lines through the web thickness represent relatively high basis weight regions, and the portions of the web illustrated with 3 lines represent relatively low basis weight regions.

Figure 16:
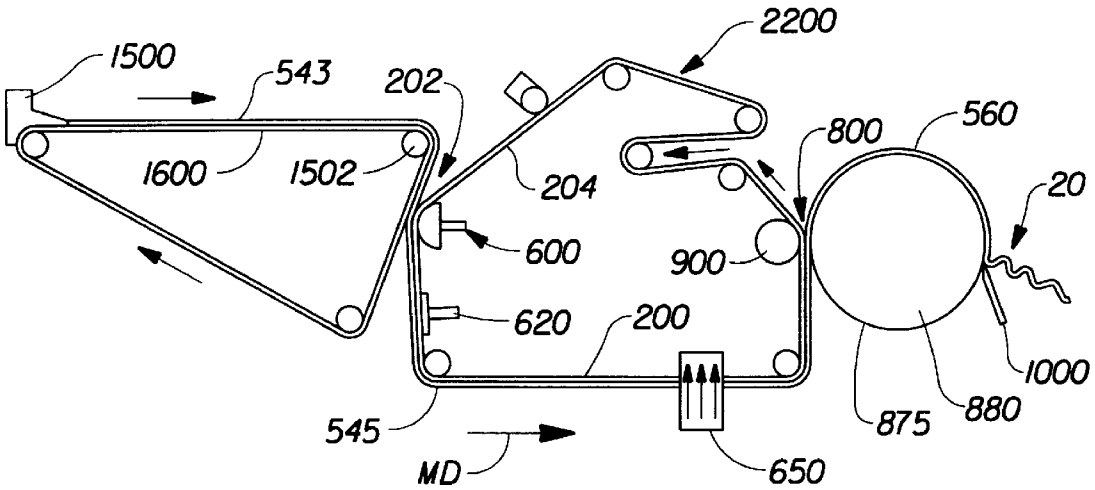
FIG. 16 is an illustration of a papermachine for making a paper web with the apparatus of FIGS. 14 and 15.
Figure 17:
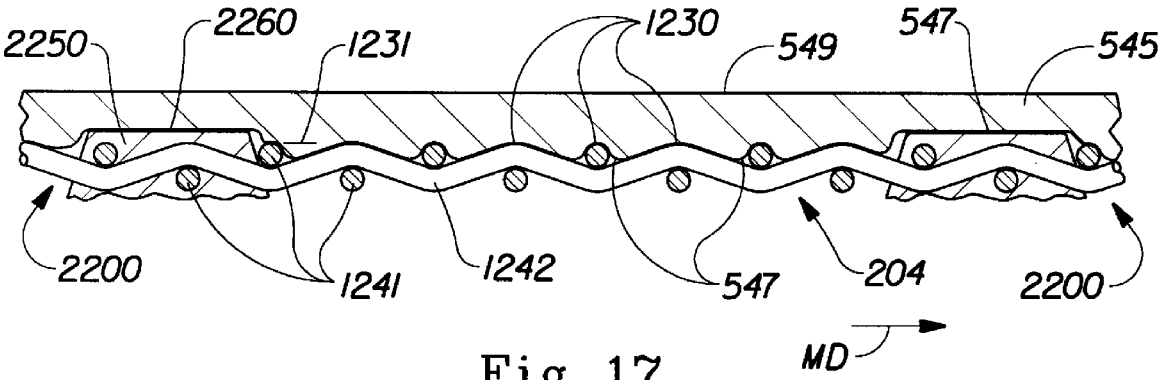
FIG. 17 is an illustration showing a paper web transferred to the apparatus shown in FIG. 15 to form a paper web having a first surface conformed to the apparatus and a second substantially smooth surface.
Figure 18:
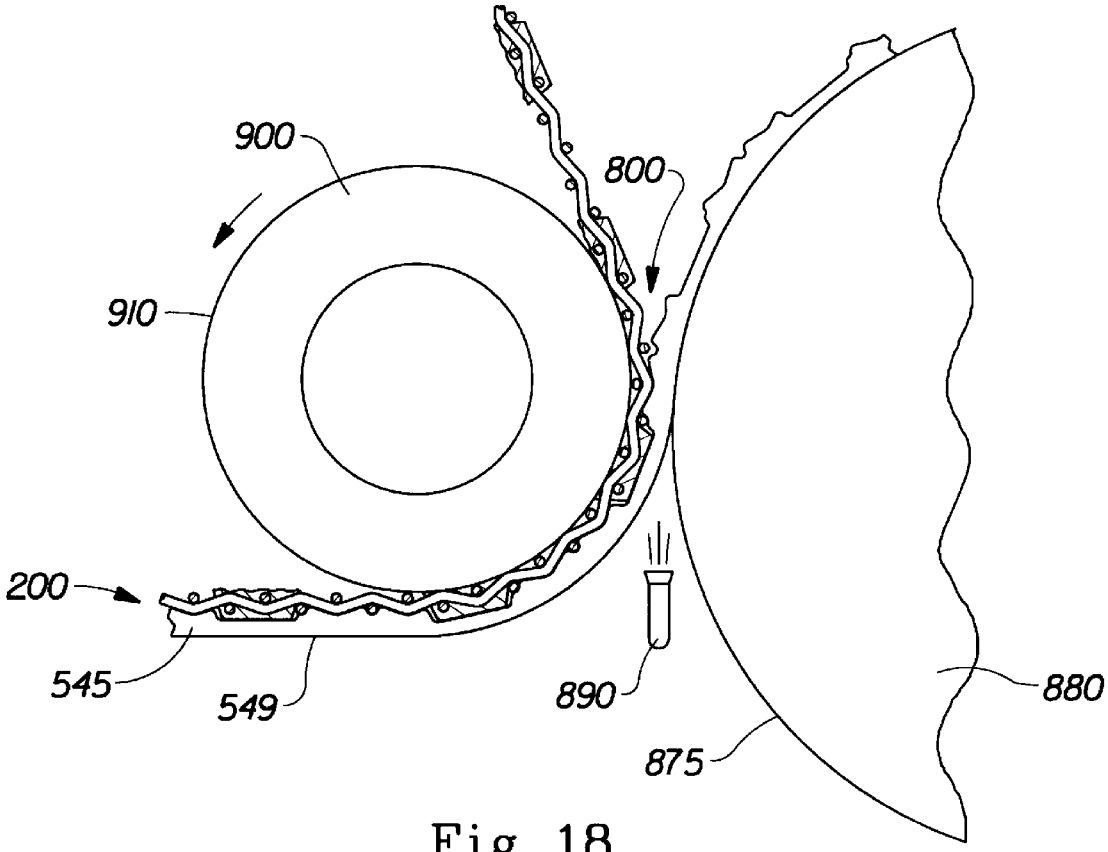
FIG. 18 is an illustration of a paper web on the apparatus shown in FIG. 15 being carried between a pressure roll and a Yankee drying drum to impart a pattern to the first surface of the paper web and to adhere the second surface of the paper web to the Yankee drum.

FIGS. 16–18 illustrate formation of a web 20 of the type shown in FIG. 12 using the web support apparatus 2200. As described above with respect to FIGS. 4–7, an embryonic web 543 having first and second smooth surfaces is formed on a forming element 1600 to have relatively low basis weight decorative indicia and a relatively high basis weight background. The web is then vacuum transferred to the apparatus 2200, to provide a web 545 supported on the first side 2202 of the apparatus 2200. As shown in FIG. 17, the first surface 547 is conformed to the surface 2260 and the surfaces 1230, and the second surface 549 is maintained as a substantially smooth, macroscopically monoplanar surface.

The web 545 and web support apparatus 2200 are next carried through a through air drying apparatus 650 (FIG. 16), wherein heated air is directed through the web 545 while the web 545 is supported on the apparatus 2200. The heated air is directed to enter the surface 549 and to pass through the web 545 and then through the apparatus 2200.

The through air drying apparatus 650 can be used to dry the web 545 to a consistency of from about 30 percent to about 70 percent. U.S. Pat. No. 3,303,576 to Sisson and U.S. Pat. Nos. 5,274,930 and 5,584,126 issued to Ensign et al. are incorporated herein by reference for the purpose of showing suitable through air dryers for use in the practice of the present invention. Alternatively, the web can be dewatered according to the teachings of U.S. Pat. No. 4,556,450 issued Dec. 3, 1985 to Chuang et al. which patent is incorporated herein by reference.

The partially dried web 545 and the apparatus 2200 are directed to pass through a nip 800 formed between a pressure roll 900 and a Yankee drum 880. The continuous network surface 2260 and the discrete surfaces 1230 are impressed into the surface 547 of the web 545 as the web is carried through the nip 800. An adhesive supplied by nozzle 890 is used to adhere substantially all of the substantially smooth surface 549 to the surface 875 of the heated Yankee drum 880.

While a single forming element 1600 is shown in FIGS. 4 and 16, it will be understood that other forming wire configurations can be used in combination with one or more headboxes, each headbox having a capability of providing one or more layers of fiber furnish, in order to provide a multiple layer web. U.S. Pat. No. 3,994,771 issued to Morgan et al. and U.S. Pat. No. 4,300,981 issued to Carstens et al. and commonly assigned U.S. Patent Application "Layered Tissue Having Improved Functional Properties" filed Oct. 24, 1996 in the names of Phan and Trokhan disclose layering and are incorporated by reference herein. Various types of forming wire configurations, including twin wire formers can be used. Additionally, various types of headbox designs can be employed to provide a web having one or more fiber layers.

In yet another embodiment, the web supported on a web support apparatus 2200 can be dewatered by pressing the web between the support apparatus, such as the type shown in FIGS. 9 or 14, and a dewatering felt layer in a press nip. The web is positioned between the web support apparatus 2200 and the dewatering felt layer in the press nip. The following patent documents are incorporated herein by reference for the purpose of illustrating dewatering of a web by pressing the web:

PCT Publications WO 96/00812 published Jan. 11, 1996, WO 96/25555 published Aug. 22, 1996, WO 96/25547 published Aug. 22, 1996, all in the name of Trokhan et al.; U.S. patent application 08/701,600 "Method for Applying a Resin to a Substrate for Use in Papermaking" filed Aug. 22, 1996; U.S. patent application 08/640,452 "High Absorbence/Low Reflectance Felts with a Pattern Layer" filed Apr. 30, 1996; and U.S. patent application 08/672,293 "Method of Making Wet Pressed Tissue Paper with Felts Having Selected Permeabilities" filed Jun. 28, 1996; and U.S. Pat. No. 5,580,423 issued Dec. 3, 1996 to Ampulski et al.

EXAMPLES

The following examples illustrate the practice of the present invention but are not intended to be limiting thereof.

Example 1

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The treated furnish streams are mixed in the headbox and deposited onto a forming element 1600 of the type shown in FIG. 6 to form a homogenous web. The forming element 1600 comprises a Fourdrinier forming wire having flow restriction members 1650 formed by a photopolymer layer cured on the forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cross-machine-direction monofilaments per inch, respectively. The monofilament diameter ranges from about 0.15 mm to about 0.20 mm. The forming wire air permeability is about 1050 scfm. Flow through the forming wire is impeded by photopolymer flow restriction members 1650 having a flower-like shape, as shown in FIG. 5. The flow restriction members 1650, combined, have a projected area equal to about 10 percent of the projected area of the forming element. The difference in elevation D (FIG. 7) is about 0.003 inch (0.076 millimeter).

The embryonic wet web is transferred from the forming element 1600, at a fiber consistency of about 10% at the point of transfer, to a web support apparatus 2200 having a dewatering felt layer 2220 and a photosensitive resin web patterning layer 2250. The dewatering felt 2220 is a Amflex 2 Press Felt. The felt 2220 comprises a batt of polyester fibers. The batt has a surface denier of 3, a substrate denier of 10–15. The felt layer 2220 has a basis weight of 1436 gm/square meter, a caliper of about 3 millimeter, and an air permeability of about 30 to about 40 scfm. The web patterning layer 2250 comprises a continuous network web contacting surface 2260 defining a plurality of discrete openings 2270 which are elongated in the machine direction (MD), as shown in FIG. 9. The web patterning layer 2250 has a projected area equal to about 35 percent of the projected area of the web support apparatus 2200. The difference in elevation 2261 between the top web contacting surface 2260 and the first felt surface 2230 is about 0.005 inch (0.127 millimeter).

The embryonic web is transferred to the web support apparatus 2200 to provide a generally monoplanar web 545.

Transfer and deflection are provided at the vacuum transfer point with a pressure differential of about 20 inches of mercury. Further de-watering is accomplished by vacuum assisted drainage until the web has a fiber consistency of about 25%. The web 545 is carried to the nip 800. The vacuum roll 900 has a compression surface 910 having a hardness of about 60 P&J. The web 545 is compacted against the compaction surface 875 of the Yankee dryer drum 880 by pressing the web 545 and the web support apparatus 200 between the compression surface 910 and the Yankee dryer drum 880 surface at a compression pressure of about 200 psi. A polyvinyl alcohol based creping adhesive is used to adhere the compacted web to the Yankee dryer. The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a two-ply bath tissue paper. The two-ply toilet tissue paper has a basis weight of about 25 pounds per 3000 square feet, and contains about 0.2% of the temporary wet strength resin and about 0.1% of the debonder. The resulting two-ply tissue paper is bulky, soft, absorbent, aesthetic and is suitable for use as bath tissues.

Example 2

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.5% by weight of the dry fibers. The Eucalyptus slurry is diluted to about 0.2% consistency at the fan pump. Third, a 3% by weight aqueous slurry of Eucalyptus fibers is made up using a conventional re-pulper. A 2% solution of the debonder (i.e., Adogen® SDMC marketed by Witco Corporation of Dublin, Ohio) and a 2% solution of dry strength binder (i.e., Redibond® 5320 marketed by National Starch and Chemical corporation of New York, N.Y.) are added to the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% debonded Eucalyptus/stream 3=100% Eucalyptus) are separated in the headbox and deposited onto a forming element 1600 of the type shown in FIG. 6 to form a 3-layer web. The forming element 1600 comprises a forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cross-machine-direction monofilaments per inch, respectively. The monofilament diameter ranges from about 0.15 mm to about 0.20 mm. The forming wire air permeability is about 1050 scfm. Flow through the forming wire is impeded with photopolymer flow restriction members 1650 having a flower-like shape, as shown in FIG. 6. The flow restriction members 1650, combined, have a projected area equal to about 10 percent of the projected area of the forming element 1600. The difference in elevation D (FIG. 7) is about 0.003 inch (0.076 millimeter).

The embryonic wet web is transferred from the forming element 1600, at a fiber consistency of about 10% at the point of transfer, to a web support apparatus 2200 having a dewatering felt layer 2220 and a photosensitive resin web patterning layer 2250. The dewatering felt 2220 is a Amflex 2 Press Felt. The felt 2220 comprises a batt of polyester fibers. The batt has a surface denier of 3, a substrate denier of 10–15. The felt layer 2220 has a basis weight of 1436 gm/square meter, a caliper of about 3 millimeter, and an air permeability of about 30 to about 40 scfm. The web patterning layer 2250 comprises a continuous web contacting surface 2260 defining discrete openings 2270, as shown in FIG. 9. The web patterning layer 2250 has a projected area equal to about 35 percent of the projected area of the web support apparatus 2200. The difference in elevation 2261 between the top web contacting surface 2260 and the first felt surface 2230 is about 0.010 inch (0.254 millimeter).

The embryonic web is transferred to the web support apparatus 2200 to provide a generally monoplanar web 545. Transfer and deflection are provided at the vacuum transfer point with a pressure differential of about 20 inches of mercury. Further de-watering is accomplished by vacuum assisted drainage until the web has a fiber consistency of about 25%. The web 545 is carried to the nip 800. The vacuum roll 900 has a compression surface 910 having a hardness of about 60 P&J. The web 545 is compacted against the compaction surface 875 of the Yankee dryer drum 880 by pressing the web 545 and the web support apparatus 200 between the compression surface 910 and the Yankee dryer drum 880 surface at a compression pressure of about 200 psi. A polyvinyl alcohol based creping adhesive is used to adhere the compacted web to the Yankee dryer. The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a two-ply bath tissue paper. The two-ply bath tissue paper has a basis weight of about 25 pounds per 3000 square feet, and contains about 0.2% of the temporary wet strength resin and about 0.1% of the debonder. The resulting two-ply tissue paper is bulky, soft, absorbent, aesthetic and is suitable for use as bath tissues.

Example 3

First, a 3% by weight aqueous slurry of Northern Softwood Kraft (NSK) fibers is made using a conventional re-pulper. A 1% solution of the permanent wet strength resin (i.e. Kymene® 557H marketed by Hercules Incorporated of Wilmington, Del.) is added to the furnish stock pipe at a rate of 0.25% by weight of the total sheet dry fibers. A 0.25% solution of the dry strength resin (i.e., CMC from Hercules Incorporated of Wilmington, Del.) is added to the furnish stock before the fan pump at a rate of 0.05% by weight of the total sheet dry fibers. Second, a 3% by weight aqueous slurry of Eucalyptus fibers is made up using a conventional re-pulper. A 2% solution of the debonder (i.e., Adogen®

SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The individual treated furnish streams (stream 1=100% NSK/stream 2=100% Eucalyptus) are separated in the headbox and deposited onto a forming element 1600 of the type shown in FIG. 6 to form a layered web. The forming element includes a forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cross-machine-direction monofilaments per inch, respectively. The monofilament diameter ranges from about 0.15 mm to about 0.20 mm. The forming wire air permeability is about 1050 scfm. Flow through the forming wire is impeded with photopolymer flow restriction members 1650 having a flower-like shape, as shown in FIG. 6. The flow restriction members 1650, combined, have a projected area equal to about 10 percent of the projected area of the forming element 1600. The difference in elevation D (FIG. 7) is about 0.003 inch (0.076 millimeter).

The embryonic wet web is transferred from the photopolymer forming wire, at a fiber consistency of about 10% at the point of transfer, to a web support apparatus 2200 having a dewatering felt layer 2220 and a photosensitive resin web patterning layer 2250. The dewatering felt 2220 is a Amflex 2 Press Felt. The felt 2220 comprises a batt of polyester fibers. The batt has a surface denier of 3, a substrate denier of 10–15. The felt layer 2220 has a basis weight of 1436 gm/square meter, a caliper of about 3 millimeter, and an air permeability of about 30 to about 40 scfm. The web patterning layer 2250 comprises a continuous network web contacting surface 2260 defining discrete openings 2270, as shown in FIG. 9. The web patterning layer 2250 has a projected area equal to about 35 percent of the projected area of the web support apparatus 2200. The difference in elevation 2261 between the top web contacting surface 2260 and the first felt surface 2230 is about 0.010 inch (0.254 millimeter).

The embryonic web is transferred to the web support apparatus 2200. Transfer and deflection are provided at the vacuum transfer point with a pressure differential of about 20 inches of mercury. Further de-watering is accomplished by vacuum assisted drainage, and optionally, by pressing the web between the web support apparatus and a separate dewatering felt. After pressing, the web is carried to the nip 800. The vacuum roll 900 has a compression surface 910 having a hardness of about 60 P&J. The web 545 is compacted against the compaction surface 875 of the Yankee dryer drum 880 by pressing the web 545 and the web support apparatus 200 between the compression surface 910 and the Yankee dryer drum 880 surface at a compression pressure of about 200 psi. A polyvinyl alcohol based creping adhesive is used to adhere the compacted web to the Yankee dryer. The fiber consistency is increased to at least about 90% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 650 fpm (200 meters per minutes).

The decorative web is converted into a two-ply facial tissue paper. The two-ply facial tissue paper has a basis weight of about 18 pounds per 3000 square feet, contains about 1% of the permanent wet strength resin, about 0.2% of the dry strength binder and about 0.1% of the debonder. The resulting two-ply tissue paper is bulky, soft, absorbent, aesthetic and is suitable for use as facial tissues.

PROPHETIC EXAMPLES

The following prophetic examples provide non-limiting illustrations of the practice of the present invention.

Example 4

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The treated furnish streams are mixed in the headbox and deposited onto a forming element 1600 of the type shown in FIG. 6 to form a homogeneous web. The forming element includes a forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cross-machine-direction monofilaments per inch, respectively. The monofilament diameter ranges from about 0.15 mm to about 0.20 mm. The forming wire air permeability is about 1050 scfm. The forming wire is impeded with photo-polymer flow restriction member 1650 having a flower-like shape, as shown in FIG. 6. The flow restriction members 1650, combined, have a projected area equal to about 10 percent of the projected area of the forming element 1600. The difference in elevation D (FIG. 7) is about 0.003 inch (0.076 millimeter).

The embryonic wet web is transferred from the forming element 1600, at a fiber consistency of about 10% at the point of transfer, to a web support apparatus 2200 of the type shown in FIGS. 14–15 made in accordance with U.S. Pat. No. 4,528,239, Trokhan, issued on 9 Jul. 1985, which patent is incorporated herein by reference. The difference in elevation between the elevations 2261 and 1231 (FIG. 15) is about 0.015 inch (0.38 millimeter). Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA).

The fiber consistency is increased to at least about 90% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 650 fpm (200 meters per minutes).

The decorative web is converted into a two-ply bath tissue paper. The two-ply toilet tissue paper has a basis weight of about 25 pounds per 3000 square feet, and contains about 0.2% of the temporary wet strength resin and about 0.1% of the debonder. The resulting two-ply tissue paper is bulky, soft, absorbent, aesthetic and is suitable for use as bath tissues.

Example 5

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The individual treated furnish streams (stream 1=100% Eucalyptus/stream 2=100% NSK/stream 3=100% Eucalyptus) are separated in the headbox and deposited onto a forming element 1600 of the type shown in FIG. 6 to form a 3 layer web. The forming element includes a forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cros-smachine-direction monofilaments per inch, respectively. The monofilament diameter ranges from about 0.15 mm to about 0.20 mm. The forming wire air permeability is about 1050 scfm. Flow through the forming wire is impeded with photo-polymer flow restriction member 1650 having a flower-like shape, as shown in FIG. 6. The flow restriction members 1650, combined, have a projected area equal to about 10 percent of the projected area of the forming element 1600. The difference in elevation D (FIG. 7) is about 0.003 inch (0.076 millimeter).

The embryonic wet web is transferred from the forming element 1600 at a fiber consistency of about 10% at the point of transfer, to a 44×33 drying/imprinting fabric of the type shown in U.S. Pat. No. 4,191,609 issued to Trokhan on Mar. 4, 1980, incorporated herein by reference. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA).

The fiber consistency is increased to at least about 90% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 650 fpm (200 meters per minutes).

The decorative web is converted into a single-ply bath tissue paper. The single-ply toilet tissue paper has a basis weight of about 18 pounds per 3000 square feet, and contains about 0.3% of the temporary wet strength resin and about 0.1% of the debonder. The resulting single-ply tissue paper is bulky, soft, absorbent, aesthetic and is suitable for use as bath tissues.

Example 6

First, a 3% by weight aqueous slurry of Northern Softwood Kraft (NSK) fibers is made using a conventional re-pulper. A 2% solution of the temporary wet strength resin (i.e., PAREZ® 750 marketed by American Cyanamid corporation of Stanford, Conn.) is added to the NSK stock pipe at a rate of 0.2% by weight of the dry fibers. The NSK slurry is diluted to about 0.2% consistency at the fan pump. Second, a 3% by weight aqueous slurry of Eucalyptus fibers is made up using a conventional re-pulper. A 2% solution of the debonder (i.e., Adogen® SDMC marketed by Witco Corporation of Dublin, Ohio) is added to one of the Eucalyptus stock pipe at a rate of 0.1% by weight of the dry fibers. The Eucalyptus slurry is diluted to about 0.2% consistency at the fan pump.

The individual treated furnish streams (stream 1=100% Eucalyptus/stream 2=100% NSK/stream 3=100% Eucalyptus) are separated in the headbox and deposited onto a forming element 1600 of the type shown in FIG. 6 to form a 3 layer web. The forming element includes a forming wire. Dewatering occurs through the forming wire and is assisted by a deflector and vacuum boxes. The forming wire, manufactured by Appleton Wire of Appleton, Wis., is a triple-layer square weave configuration having 90 machine-direction and 72 cross-machine-direction monofilaments per inch, respectively. The monofilament diameter ranges from about 0.15 mm to about 0.20 mm. The forming wire air permeability is about 1050 scfm. Flow through the forming wire is impeded with photopolymer flow restriction members 1650 having a flower-like shape, as shown in FIG. 6. The flow restriction members 1650, combined, have a projected area equal to about 10 percent of the projected area of the forming element 1600. The difference in elevation D (FIG. 7) is about 0.003 inch (0.076 millimeter).

The embryonic wet web is transferred from the forming element 1600, at a fiber consistency of about 10% at the point of transfer, to a web support apparatus 2200 comprising a photopolymer layer cast onto a woven reinforcing member in accordance with U.S. Pat. No. 4,528,239, Trokhan, issued on 9 Jul. 1985. The woven reinforcing member has about 59 filaments extending in the machine direction and about 44 filaments extending in the cross machine direction, and can be made in accordance with U.S. Pat. No. 4,191,609 issued Mar. 4, 1980 to Trokhan.

The difference in elevation between 2261 AND 1231 (FIG. 15) is about 0.003 inch (0.076 millimeter). Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA).

The fiber consistency is increased to at least about 90% before dry creping the web with a doctor blade. The doctor blade has a bevel angle of about 20 degrees and is positioned with respect to the Yankee dryer to provide an impact angle of about 76 degrees; the Yankee dryer is operated at about 800 fpm (feet per minute) (about 244 meters per minute). The dry web is formed into roll at a speed of 650 fpm (200 meters per minutes).

The decorative web is converted into a single-ply bath tissue paper. The single-ply toilet tissue paper has a basis weight of about 18 pounds per 3000 square feet, and contains about 0.3% of the temporary wet strength resin and about 0.1% of the debonder. The resulting single-ply tissue paper is bulky, soft, absorbent, aesthetic and is suitable for use as bath tissues.

TEST METHODS

Surface Smoothness

The surface smoothness of a side of a paper web is measured based upon the method for measuring physiological surface smoothness (PSS) set forth in the 1991 International Paper Physics Conference, TAPPI Book 1, article entitled "Methods for the Measurement of the Mechanical Properties of Tissue Paper" by Ampulski et al. found at page 19, which article is incorporated herein by reference. The PSS measurement as used herein is the point by point sum of amplitude values as described in the above article. The measurement procedures set forth in the article are also generally described in U.S. Pat. No. 4,959,125 issued to Spendel and U.S. Pat. No. 5,059,282 issued to Ampulski et al, which patents are incorporated herein by reference.

For purposes of testing the paper samples of the present invention, the method for measuring PSS in the above article is used to measure surface smoothness, with the following procedural modifications:

Instead of importing digitized data pairs (amplitude and time) into SAS software for 10 samples, as described in the above article, the Surface Smoothness measurement is made by acquiring, digitizing, and statistically processing data for the 10 samples using LABVIEW brand software available from National Instruments of Austin, Tex. Each amplitude spectrum is generated using the "Amplitude and Phase Spectrum.vi" module in the LABVIEW software package, with "Amp Spectrum Mag Vrms" selected as the output spectrum. An output spectrum is obtained for each of the 10 samples.

Each output spectrum is then smoothed using the following weight factors in LABVIEW: 0.000246, 0.000485, 0.00756, 0.062997. These weight factors are selected to imitate the smoothing provided by the factors 0.0039, 0.0077, 0.120, 1.0 specified in the above article for the SAS program.

After smoothing, each spectrum is filtered using the frequency filters specified in the above article. The value of PSS, in microns, is then calculated as described in the above mentioned article, for each individually filtered spectrum. The Surface Smoothness of the side of a paper web is the average of the 10 PSS values measured from the 10 samples taken from the same side of the paper web. Similarly, the Surface Smoothness of the opposite side of the paper web can be measured. The smoothness ratio is obtained by dividing the higher value of Surface Smoothness, corresponding to the more textured side of the paper web, by the lower value of Surface Smoothness, corresponding to the smoother side of the paper web.

Basis Weight

The basis weight of the web (macro basis weight) is measured using the following procedure.

The paper to be measured is conditioned at 71–75 degrees Fahrenheit at 48 to 52 percent relative humidity for a minimum of 2 hours. The conditioned paper is cut to provide twelve samples measuring 3.5 inch by 3.5 inch. The samples are cut, six samples at a time, with a suitable pressure plate cutter, such as a Thwing-Albert Alfa Hydraulic Pressure Sample Cutter, Model 240-10. The two six sample stacks are then combined into a 12 ply stack and conditioned for at least 15 additional minutes at 71 to 75 F and 48 to 52 percent humidity.

The 12 ply stack is then weighed on a calibrated analytical balance. The balance is maintained in the same room in which the samples were conditioned. A suitable balance is made by Sartorius Instrument Company, Model A200S. This weight is the weight in grams of a 12 ply stack of the paper, each ply having an area of 12.25 square inches.

The basis weight of the paper web (the weight per unit area of a single ply) is calculated in units of pounds per 3,000 square feet, using the following equation:

$$\text{Weight of 12 ply stack (grams)} \times 3000 \times 144 \text{ sq inch per sq ft.}/(453.6 \text{ gm/lb}) \times (12 \text{ plies}) \times (12.25 \text{ sq. in. per ply})$$

or simply:

$$\text{Basis Weight (lb/3,000 ft}^2) = \text{Weight of 12 ply stack (gm)} \times 6.48$$

Basis Weight of Background

The basis weight of the background portion of the web is measured using the following procedure. Samples of the background portion (samples do not include decorative indicia or portions of decorative indicia) are cut from the paper web. The samples are cut to be as large as possible without including decorative indicia. The area of each sample is measured, and the sample is weighed. The basis weight of the background is calculated by dividing the weight of the sample by the area of the sample. At least three samples are measured and the results averaged to obtain the basis weight of the background portion.

Basis Weight of Relatively Low Basis Weight Regions

The basis weight of the relatively low basis weight regions is measured using the following procedure.

The surface area of the relatively low basis weight regions is determined using a computer, a scanner, and an image analysis software program. A suitable computer is an Apple Macintosh Model 7200/90. A suitable scanner is an AGFA Arcus II brand scanner available from AGFA-Gevaert N.V. of Belgium and having 600 dpi resolution. Suitable image analysis software is NIH IMAGE Version 1.59 available from the National Institute of Health.

The following procedure is used to scan samples and measure the surface area of the relatively low basis weight regions in the sample. Samples are cut from a paper web, each sample including a decorative indicia surrounded by the background. Each sample is weighed to obtain the total weight, TW, of the sample Each sample is mounted on a piece of black paper to provide a dark background during scanning. The mounted sample is scanned using the AGFA Arcus II scanner. The images are scanned into the computer using Adobe Photoshop Version 3.0.5 brand software. The Adobe software is augmented with a FotoLook P.S. 2.07.2 brand plugin module available from AGFA-Gevaert. The scan settings are set to: automatic, 600 dpi resolution, greyscale (not color). The mounted sample is scanned along with a ruler to provide geometric calibration.

The scanned image for each sample is then opened in the NIH IMAGE software and calibrated with the ruler image. The calibration factor is about 235.2 pixels per millimeter. The image analysis software is used to measure the total area of the sample based on the perimeter of the sample.

The image is then smoothed twice using a 3×3 kernel prior to defining the outline of the decorative indicia. The image is then density sliced to highlight pixels having a greyscale value between 64 and 254. The magic wand tool is then used to outline the decorative indicia, including all the relatively low basis weight regions included in the indicia. The portions of the image outside the decorative indicia are discarded, and the image of the decorative indicia is pasted to a new file. The magic wand is then next used to cut away the relatively high basis weight portions (the cells) within the decorative indicia, leaving only the portions of the image corresponding to the relatively low basis weight regions. The image of the relatively low basis weight regions is then density sliced to select those pixels having a grey-scale value of 64–254. The software then calculates the area of the selected pixels to provide the surface area of relatively low basis weight regions in the decorative indicia.

Once the surface area of the relatively low basis weight regions has been measured using the image analysis software, the basis weight of the relatively low basis weight regions is determined by solving for BW1 in the following equation:

$$TW=(BW1)\times(AREA1)+(BW2)\times(AREA2)$$

where TW is the total weight of the sample having the decorative indicia, BW1 is the basis weight of the relatively low basis weight regions, AREA1 is the area of the relatively low basis weight regions measured using the image analysis software, BW2 is the basis weight of the background region which can be measured from samples cut from the background as described above, and AREA2 is the area of the background of the sample. The value of AREA2 is the total area of the sample (calculated based on the perimeter of the sample) minus the value of AREA1. Accordingly, the above equation can be used to solve for the value of BW1. At least three samples are measured and the results averaged to determine the basis weight of the relatively low basis weight regions.

Macro-Caliper or Dry Caliper

The Macro-Caliper or dry caliper is measured using the procedure for measuring dry caliper disclosed in U.S. Pat. No. 4,469,735, issued Sep. 4, 1984 to Trokhan, which patent is incorporated herein by reference.

Bulk Density

Bulk Density is the basis weight of the web divided by the web's macrocaliper, and is reported in units of weight per unit volume. An appropriate conversion factor may be used if the basis weight and the caliper are measured using different units.

Absorbent Capacity

The absorbent capacity of a web is measured using the Horizontal Absorbative Capacity Test disclosed in above referenced U.S. Pat. No. 4,469,735.

Measurement of Web Support Apparatus Elevations

The elevation difference between the elevation 231 of the first felt surface and the elevation 261 of the web contacting surface 260 is measured using the following procedure. The web support apparatus is supported on a flat horizontal surface with the web patterning layer facing upward. A stylus having a circular contact surface of about 1.3 square millimeters and a vertical length of about 3 millimeters is mounted on a Federal Products dimensioning gauge (model 432B-81 amplifier modified for use with an EMD-4320 W1 breakaway probe) manufactured by the Federal Products Company of Providence, R.I. The instrument is calibrated by determining the voltage difference between two precision shims of known thickness which provide a known elevation difference. The instrument is zeroed at an elevation slightly lower than the first felt surface 230 to insure unrestricted travel of the stylus. The stylus is placed over the elevation of interest and lowered to make the measurement. The stylus exerts a pressure of about 0.24 grams/square millimeter at the point of measurement. At least three measurements are made at each elevation. The measurements at each elevation are averaged. The difference between the average values is the calculated to provide the elevation difference.

The same procedure is used to measure the difference between elevations 1231 and 2261.

What is claimed is:

1. A paper web having oppositely facing surfaces and at least three regions, the three regions disposed in a nonrandom, repeating pattern and being distinguishable from each other by at least one property selected from the group consisting of basis weight, density, and fiber composition; and wherein the paper web comprises a high basis weight background region having a first basis weight and decorative indicia, the decorative indicia comprising one or more low basis weight regions having a basis weight which is lower than the first basis weight of at least a part of the surrounding background region of the paper web.

2. The paper web of claim 1 wherein the decorative indicia are imparted to the web by selective drainage of water from the web.

3. The paper web of claim 1 wherein the decorative indicia comprise low basis weight regions having a basis weight of less than about 15 grams/square meter.

4. The paper web of claim 3 comprising a plurality of discrete, spaced apart decorative indicia, and wherein the background region separates the discrete decorative indicia.

5. The paper web of claim 4 comprising between about 5 and about 5000 discrete decorative indicia per square meter of surface of the web.

6. The paper web of claim 5 wherein the background region comprises at least one high density region and at least one low density region having a density lower than the density of the high density region, and wherein the high density region and the low density region have a basis weight which is greater than the basis weight of the low basis weight regions of the decorative indicia.

7. The paper web of claim 6 wherein the background region comprises a high density, continuous network region and a plurality of discrete, low density regions having a density lower than the density of the high density continuous network region, the low density regions being dispersed throughout the high density continuous network region.

8. The paper web of claim 7 wherein the high density, continuous network region and the discrete, low density regions have different crepe frequencies.

9. The paper web of claim 8 wherein the background region comprises at least about 10,000 discrete, low density regions per square meter of the web.

10. The paper web of claim 4 wherein each decorative indicia comprises low basis weight regions having a closed path shape completely encircling at least one high basis weight region, and wherein the width of the low basis weight region as measured at any point along the closed path shape is between about 0.2 millimeter and about 2 millimeter.

11. The paper web of claim 10 wherein the low basis weight regions have a closed path shape outlining a plurality of adjacent, high basis weight cells, wherein the basis weight everywhere within each of the cells is higher than the basis weight of the low basis weight region, and wherein each cell has a perimeter formed by a closed loop portion of the low basis weight region.

12. The paper web of claim 11 wherein each cell shares no more than half of its perimeter with any one adjacent cell.

13. The paper web of claim 1 wherein the bulk density of the paper web is less than about 0.12 gram per cubic centimeter.

14. The paper web of claim 1 wherein the background region has a surface smoothness value of less than about 900 on at least one of the oppositely facing surfaces of the paper web.

15. A paper structure comprising multiple plies of the paper web of claim 1.

16. The paper web of claim 1 comprising long papermaking fibers and short papermaking fibers shorter than the long papermaking fibers, and wherein the average fiber length of the papermaking fibers in the low basis weight regions of the decorative indicia is greater than the average fiber length of the papermaking fibers in surrounding portions of the paper web.

17. A wetlaid paper web having oppositely facing surfaces, the paper web comprising:

between 5 and 5000 discrete decorative indicia per square meter of surface of the web, each decorative indicia comprising one or more low basis weight regions; and a high basis weight background region having a basis weight higher than the basis weight of the low basis weight regions and separating the decorative indicia, the background region comprising regions of different density disposed in a nonrandom, repeating pattern.

18. The paper web of claim 17 wherein the high basis weight background region comprises a high density continuous network region and a plurality of discrete, low density regions having a density lower than the high density continuous network region, dispersed throughout the continuous network region.

19. The paper web of claim 17 wherein the high basis weight background region comprises discrete, high density regions.

20. The paper web of claim 17 wherein the low basis weight regions of the decorative indicia have a basis weight of less than about 15 gram/square meter.

21. The paper web of claim 20 wherein the background region has a surface smoothness value of less than about 900 on at least one of the oppositely facing surfaces of the web.

22. The paper web of claim 20 having a bulk density of less than about 0.12 gram/cubic centimeter.

23. The paper web of claim 20 wherein the decorative indicia are imparted to the web by selective drainage of water from the web.

24. The paper web of claim 23 wherein the background comprises regions of different density which are imparted to the web after the decorative indicia are imparted to the web.

25. A paper structure comprising multiple plies of the paper web of claim 17.

26. A wetlaid paper web having oppositely facing surfaces, the paper web comprising:

between 5 and 5000 discrete decorative indicia per square meter of surface of the web, each decorative indicia comprising one or more low basis weight regions having a basis weight of less than about 15 grams/square meter; and a high basis weight background region having a basis weight higher than the basis weight of the low basis weight regions and separating the decorative indicia, the background region comprising a high density, continuous network region and at least about 10,000 discrete low density regions per square meter of the web, the low density regions having a density lower than the density of the high density region and being dispersed throughout the continuous network region, and wherein the background region has a surface smoothness value of less than about 900 on at least one of the oppositely facing surfaces of the web.

27. A wetlaid paper web having oppositely facing surfaces, the paper web comprising:

between 5 and 5000 discrete decorative indicia per square meter of surface of the web, each decorative indicia comprising one or more low basis weight regions having a basis weight of less than about 15 grams/square meter; and a high basis weight background region separating the decorative indicia, the background region comprising regions of different density disposed in a nonrandom repeating pattern, and wherein the background region comprises at least about 50,000 discrete high density regions per square meter of the web; and wherein the background region has a surface smoothness value of less than about 900 on at least one of the oppositely facing surfaces of the web.

28. A wetlaid paper web having oppositely facing surfaces, the paper web comprising:

between 5 and 5000 discrete decorative indicia per square meter of surface of the web, each decorative indicia comprising one or more low basis weight regions having a basis weight of less than about 15 grams/square meter; and a high basis weight background region separating the decorative indicia, the background region comprising a continuous network, high density region, a plurality of low density regions having a density lower than the density of the continuous network, high density region dispersed throughout the continuous network region, and a plurality of discrete, high density regions dispersed throughout each of the low density regions.

* * * * *